US005843536A

United States Patent [19]

Scharfenberger et al.

[11] Patent Number: 5,843,536

[45] Date of Patent: Dec. 1, 1998

[54] COATING MATERIAL DISPENSING AND CHARGING SYSTEM

[75] Inventors: James A. Scharfenberger, Indianapolis, Ind.; Ghaffar Kazkaz, Mount Prospect, Ill.; Varce E. Howe, Zionsville; C. Terry Duncan, Indianapolis, both of Ind.

[73] Assignee: Ransburg Corporation, Indianapolis, Ind.

[21] Appl. No.: 985,615

[22] Filed: Dec. 3, 1992

[51] Int. Cl.[6] ..... H05H 1/30

[52] U.S. Cl. ..... 427/475; 427/479; 427/483

[58] Field of Search ..... 427/475, 479, 427/483, 485

[56] References Cited

U.S. PATENT DOCUMENTS

| | | | |
|---|---|---|---|
| 1,655,262 | 1/1928 | Fortin . | |
| 2,421,787 | 6/1947 | Helmuth | 427/483 |
| 2,425,652 | 8/1947 | Starkey | 427/483 |
| 2,428,991 | 10/1947 | Ransburg | 427/483 |
| 2,463,422 | 3/1949 | Ransburg et al. | 427/483 |
| 2,673,232 | 3/1954 | Silsby, Jr. | 174/15 |
| 2,926,106 | 2/1960 | Gauthier | 117/93 |
| 2,960,273 | 11/1960 | Croskey et al. | 239/15 |
| 2,989,241 | 6/1961 | Badger | 239/15 |
| 3,021,077 | 2/1962 | Gauthier | 239/15 |
| 3,048,498 | 8/1962 | Juvinall et al. | 117/93 |
| 3,055,592 | 9/1962 | Probst | 239/15 |
| 3,098,890 | 7/1963 | Peterson | 174/5 |
| 3,122,320 | 2/1964 | Beck et al. | 239/3 |
| 3,291,889 | 12/1966 | Uline et al. | 174/8 |
| 3,360,035 | 12/1967 | Van Loo et al. | 165/105 |
| 3,393,662 | 7/1968 | Blackwell | 118/626 |
| 3,408,985 | 11/1968 | Sedlacsik, Jr. | 118/629 |
| 3,893,620 | 7/1975 | Rokadia | 239/3 |
| 3,933,285 | 1/1976 | Wiggins | 222/56 |
| 3,934,055 | 1/1976 | Tamny | 427/8 |
| 3,937,401 | 2/1976 | Luderer et al. | 239/15 |
| 4,017,029 | 4/1977 | Walberg | 239/15 |
| 4,020,866 | 5/1977 | Wiggins | 137/592 |
| 4,085,892 | 4/1978 | Dalton | 239/15 |
| 4,148,932 | 4/1979 | Tada et al. | 427/31 |
| 4,275,834 | 6/1981 | Spanjersberg et al. | 239/3 |
| 4,313,475 | 2/1982 | Wiggins | 141/18 |
| 4,343,828 | 8/1982 | Smead et al. | 427/27 |
| 4,347,984 | 9/1982 | Sickles | 239/707 |
| 4,413,788 | 11/1983 | Schaefer et al. | 239/703 |
| 4,489,893 | 12/1984 | Smead | 239/691 |
| 4,555,058 | 11/1985 | Weinstein et al. | 239/223 |
| 4,589,597 | 5/1986 | Robisch et al | 239/703 |
| 4,771,949 | 9/1988 | Behr et al. | 239/703 |
| 4,852,810 | 8/1989 | Behr | 427/483 |
| 4,872,616 | 10/1989 | Behr et al. | 239/703 |
| 4,878,622 | 11/1989 | Jamison et al. | 239/690.1 |
| 4,955,960 | 9/1990 | Behr et al. | 239/3 |
| 4,957,060 | 9/1990 | Cann | 118/699 |
| 4,982,903 | 1/1991 | Jamison et al. | 239/690.1 |
| 4,989,793 | 2/1991 | Gimple | 239/696 |
| 5,044,564 | 9/1991 | Sickles | 239/690.1 |

FOREIGN PATENT DOCUMENTS

| | | | |
|---|---|---|---|
| 3600920 | 7/1987 | Germany | B05B 3/02 |
| 1098578 | 6/1984 | U.S.S.R. | B05B 5/04 |
| 1393313 | 5/1975 | United Kingdom | B05C 3/02 |
| 1478853 | 7/1977 | United Kingdom | B05B 5/02 |

*Primary Examiner*—Glenn Caldarola
*Attorney, Agent, or Firm*—Barnes & Thornburg

[57] ABSTRACT

A coating material dispensing and charging system comprises first electrical conductors extending between first electrically non-conductive supporting members, a power supply coupled across the first conductors and articles to be coated to maintain a high magnitude electrostatic potential difference across a space defined between the first conductors and the articles, a dispenser for dispensing the coating material into the space, and a supply of coating material for the dispenser. The first electrical conductors comprise electrically conductive filaments surrounded by electrically non-conductive sheaths.

48 Claims, 17 Drawing Sheets

COATING MATERIAL DISPENSING AND CHARGING SYSTEM

BACKGROUND OF THE INVENTION

Wire grid-type charging systems for charging particles of coating material by ionization from the grid are known. The grids of such systems are maintained at high-magnitude electrostatic potentials with respect to articles to be coated by coating materials dispensed as clouds of atomized particles projected adjacent the grids. As the particles pass adjacent the grids, the particles are ionized, thereby becoming electrically attracted to the articles. Such systems, which employed this so-called Ransburg number 1 process, were in use for metal finishing and similar applications during the '40's and '50's. See, for example, U.S. Pat. Nos. 2,421,787; 2,428,991; and 2,463,422. This process was employed during a time when organic solvent-base coatings were used extensively for metal finishing and similar applications.

Over the years the Ransburg number 1 process gave way to the so-called Ransburg number 2 process, wherein coating material is atomized from the edge of a spinning disk or bell-shaped atomizer. The coating material is fed to a location nearer the center of the rotary atomizer and is spread to a thin film as it migrates outward toward the atomizing edge, owing to centrifugal force on the coating material film, as in U.S. Pat. No. 4,148,932, or jointly to centrifugal force and electrostatic effects, as in U.S. Pat. Nos.: 2,926,106; 2,989,241; 3,021,077; and 3,055,592. Typically, the spinning disk or bell-shaped atomizer is maintained at a high-magnitude electrostatic potential with respect to the articles to be coated by the coating material. At the atomizing edge, the electrostatically charged particles tear away from the film and are attracted toward typically grounded articles to be coated by the thus-atomized particles.

The Ransburg number 2 process continues to be one of the generally accepted techniques in common use today for coating articles of almost every kind imaginable. Two factors, however, have combined to exert significant innovative pressure on the Ransburg number 2 process, and many other types of material coating processes as well. The first of these is that, generally speaking, the organic solvents which form the bases of, many of the coating materials dispensed during such processes are flammable. This requires considerable care during the conduct of such processes, particularly in view of the high-magnitude electrostatic potentials which typically are maintained across the coating dispensing device-to-target space. This pressure for innovation in the safety area has been addressed in a number of ways. There are, for example, the disclosures of U.S. Pat. Nos. 3,048,498 and 4,957,060.

The second development placing pressure to innovate on the Ransburg number 2 process and other processes was brought about by the constant effort to reduce the amounts of volatile organic emissions from all types of coating processes in response to environmental concern and the resulting ever stricter environmental regulation. The increasing environmental sensitivity to these processes has led to the increasing use of water-base, as opposed to organic solvent-base, coatings. Environmental concerns about such processes are substantially reduced when water-base coatings are used, since the principal vehicle released during the drying or curing of water-base coatings is water vapor. The reason this has had an impact on the viability of such processes as the Ransburg number 2 process is that water is electrically much more conductive than most of the organic solvents conventionally used in organic solvent-base coatings. This means that special measures must be employed in the equipment and processes by which the water-base coating materials are supplied to the coating material atomizing and dispensing apparatus. Evidence of the kinds of measures which may be adopted under such circumstances can be found in, for example, U.S. Pat. Nos.: 1,655,262; 2,673,232; 3,098,890; 3,291,889; 3,360,035; 4,020,866; 3,122,320; 3,893,620; 3,933,285; 3,934,055; 4,017,029; 4,275,834; 4,313,475; 4,085,892; 4,413,788; 4,878,622; and 4,982,903; British Patent Specification 1,478,853; and British Patent Specification 1,393,313. Other systems which address the issue of spraying electrically charged, electrically highly conductive coatings from other perspectives include, for example, U.S. Pat. Nos.: 2,960,273; 3,393,662; 3,408,985; 3,937,401; 4,343,828; 4,347,984; 4,489,893; 4,555,058; 4,589,597; 4,771,949; 4,852,810; 4,872,616; 4,955,960; 4,989,793; and, 5,044,564; German published Patent Application 3,600,920; and, Soviet Union Published Patent Document 1,098,578. No representation is intended, nor should any such representation be inferred, that the above listing is a complete listing of all of the pertinent prior art, or that a thorough search of the prior art has been conducted.

"Electrically non-conductive" and "electrically non-insulative" are relative terms. In the context of this application, "electrically non-conductive" means electrically less conductive than "electrically non-insulative." Conversely, in the context of this application, "electrically non-insulative" means electrically more conductive than "electrically non-conductive." In the same way, "electrically non-conductive" means electrically less conductive than "electrically conductive" and "electrically conductive" means electrically more conductive than "electrically non-conductive."

SUMMARY OF THE INVENTION

According to one aspect of the invention, a coating material dispensing and charging system comprises first electrical conductors extending between first electrically non-conductive supporting members, a power supply, means for coupling the power supply across the first conductors and articles to be coated to maintain a high magnitude electrostatic potential difference across a space defined between the first conductors and the articles, a dispenser for dispensing the coating material into the space, a supply of coating material, and means for supplying the coating material from the coating material supply to the dispenser. The first electrical conductors comprise electrically conductive filaments surrounded by electrically non-conductive sheaths.

According to another aspect of the invention, a coating material dispensing and charging system comprises first electrical conductors extending between first electrically non-conductive supporting members, a power supply, means for coupling the power supply across the first conductors and articles to be coated to maintain a high magnitude electrostatic potential difference across a space defined between the first conductors and the articles, a dispenser for dispensing the coating material into the space, a supply of coating material, and means for supplying the coating material from the coating material supply to the dispenser. The first electrical conductors comprise electrically non-insulative materials applied to electrically non-conductive substrates.

According to yet another aspect of the invention, a method of dispensing coating material comprises providing first electrically conductive filaments surrounded by electrically non-conductive sheaths and extending between first electrically non-conductive supporting members, providing a dispenser for dispensing the coating material, providing a supply of coating material to the dispenser, coupling the power supply across the first electrically conductive filaments and the articles to be coated to maintain a high magnitude electrostatic potential difference across a space defined between the first electrically conductive filaments and the articles, and dispensing the coating material into the space.

According to a further aspect of the invention, a method of dispensing coating material comprises providing first electrically non-insulative materials applied to electrically non-conductive substrates extending between first electrically non-conductive supporting members, providing a dispenser for dispensing the coating material, providing a supply of coating material to the dispenser, coupling the power supply across the first conductors and the articles to be coated to maintain a high magnitude electrostatic potential difference across a space defined between the first conductors and the articles, and dispensing the coating material into the space.

According to a still further aspect of the invention, a coating material dispensing and charging system comprises first fine metal wires surrounded by electrically non-conductive sheaths comprising material selected from the group consisting of synthetic materials and glass. The first fine metal wires extend between first electrically non-conductive supporting members. The system further comprises a power supply, means for coupling the power supply across the first fine metal wires and articles to be coated to maintain a high magnitude electrostatic potential difference across a space defined between the first fine metal wires and the articles, a dispenser for dispensing the coating material into the space, a supply of coating material, and means for supplying the coating material from the coating material supply to the dispenser.

According to another aspect of the invention, a coating material dispensing and charging system comprises first metal wires wound around electrically non-conductive filaments and extending between first electrically non-conductive supporting members, a power supply, means for coupling the power supply across the first metal wires and articles to be coated to maintain a high magnitude electrostatic potential difference across a space defined between the first metal wires and the articles, a dispenser for dispensing the coating material into the space, a supply of coating material, and means for supplying the coating material from the coating material supply to the dispenser.

According to still another aspect of the invention, a coating material dispensing and charging system comprises first electrical conductors extending between first electrically non-conductive supporting members. The first electrical conductors comprise electrically non-insulative material applied to electrically non-conductive substrates. The system further comprises a power supply, means for coupling the power supply across the first conductors and articles to be coated to maintain a high magnitude electrostatic potential difference across a space defined between the first conductors and the articles, a dispenser for dispensing the coating material into the space, a supply of coating material, and means for supplying the coating material from the coating material supply to the dispenser. The electrically non-conductive substrates comprise electrically non-conductive filaments, and the electrically non-insulative material comprises a carbon-containing coating applied to the electrically non-conductive filaments.

According to yet another aspect of the invention, a coating material dispensing and charging system comprises first electrical conductors extending between first electrically non-conductive supporting members. The first electrical conductors comprise electrically conductive filaments surrounded by electrically semiconductive sheaths. The system further comprises a power supply, means for coupling the power supply across the first conductors and articles to be coated to maintain a high magnitude electrostatic potential difference across a space defined between the first conductors and the articles, a dispenser for dispensing the coating material into the space, a supply of coating material, and means for supplying the coating material from the coating material supply to the dispenser.

According to another aspect of the invention, a coating material dispensing and charging system comprises a first electrical conductor extending between a first electrically non-conductive supporting member and a second electrically non-conductive supporting member, means for moving one of the first and second electrically non-conductive supporting members relative to the other of the first and second electrically non-conductive supporting members to move the first electrical conductor generally in a plane adjacent articles to be coated by the coating material, a power supply, means for coupling the power supply across the first conductor and articles to be coated to maintain a high magnitude electrostatic potential difference across a space defined between the first conductor and the articles, a dispenser for dispensing the coating material into the space, a supply of coating material, and means for supplying the coating material from the coating material supply to the dispenser.

According to still another aspect of the invention, a coating material dispensing and charging system comprises first electrical conductors extending between first electrically non-conductive supporting members. The first electrical conductors comprise electrically non-insulative material applied to electrically non-conductive substrates. The system further comprises a power supply, means for coupling the power supply across the first conductors and articles to be coated to maintain a high magnitude electrostatic potential difference across a space defined between the first conductors and the articles, a dispenser for dispensing the coating material into the space, a supply of coating material, and means for supplying the coating material from the coating material supply to the dispenser. The electrically non-conductive substrates comprise tubes of electrically non-conductive material, and the electrically non-insulative materials comprise electrically non-insulative insulating coating applied to the insides of the tubes and fine wire-like electrodes extending through the walls of the tubes in electrical contact with the electrically non-insulative coating and exposed to the space.

According to yet another aspect of the invention, a coating material dispensing and charging system comprises first electrical conductors extending between first electrically non-conductive supporting members. The first electrical conductors comprise electrically non-insulative material applied to electrically non-conductive substrates. The system further comprises a power supply, means for coupling the power supply across the first conductors and articles to be coated to maintain a high magnitude electrostatic potential difference across a space defined between the first conductors and the articles, a dispenser for dispensing the coating material into the space, a supply of coating material, and means for supplying the coating material from the coating material supply to the dispenser. The electrically non-conductive substrates comprise strips of electrically non-conductive material, and the electrically non-insulative materials comprising electrically non-insulative coating applied to the strips and fine wire-like electrodes mounted on the strips in electrical contact with the electrically non-insulative coating and exposed to the space.

BRIEF DESCRIPTION OF THE DRAWINGS

The invention may best be understood by referring to the following description and accompanying drawings which illustrate the invention. In the drawings

DETAILED DESCRIPTION OF ILLUSTRATIVE EMBODIMENTS

Figure 1:
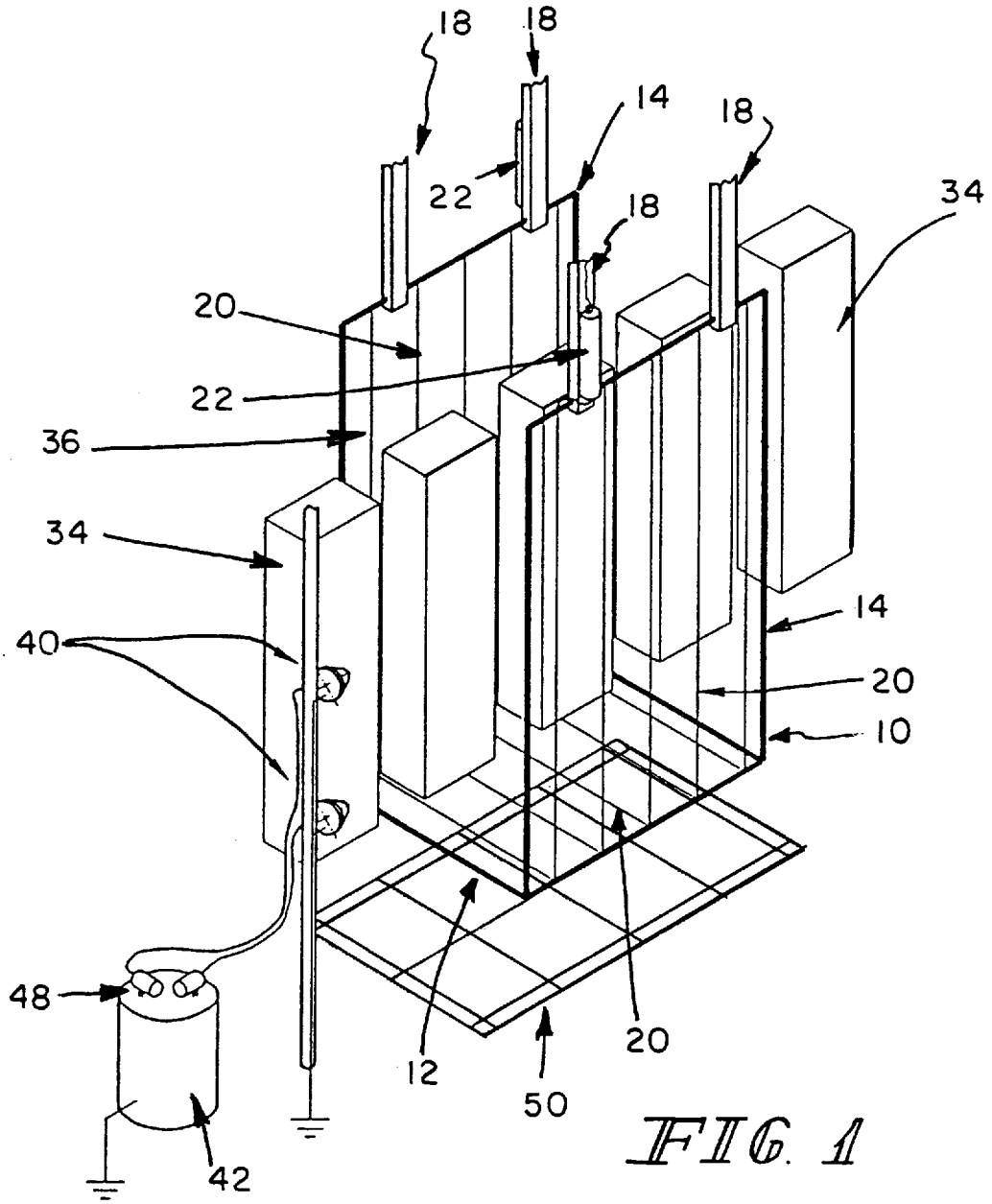
FIG. 1 illustrates a fragmentary perspective view of a system constructed according to the present invention.
Figure 2:
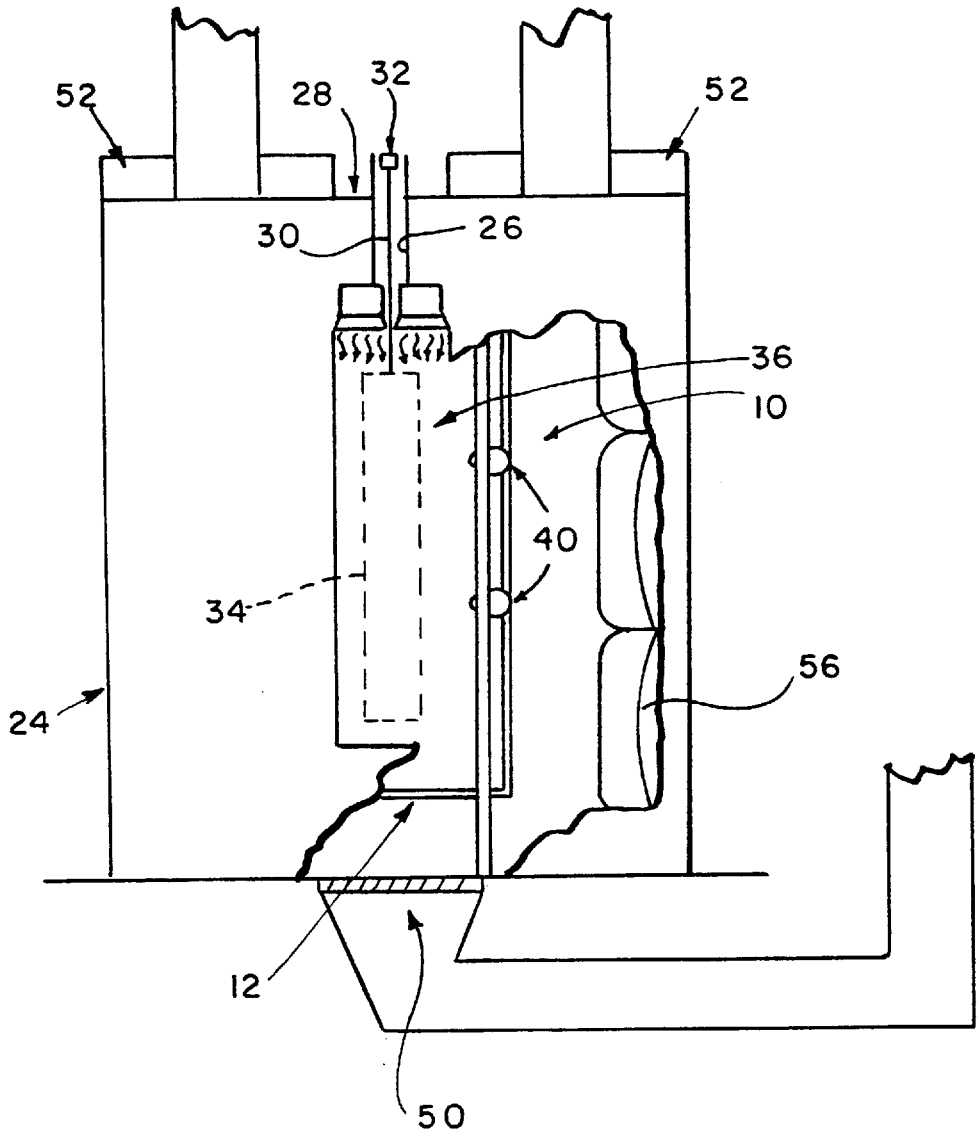
FIG. 2 illustrates a fragmentary end elevational view of the system illustrated in FIG. 1 taken generally along section lines 2—2 of FIG. 1.
Figure 3:
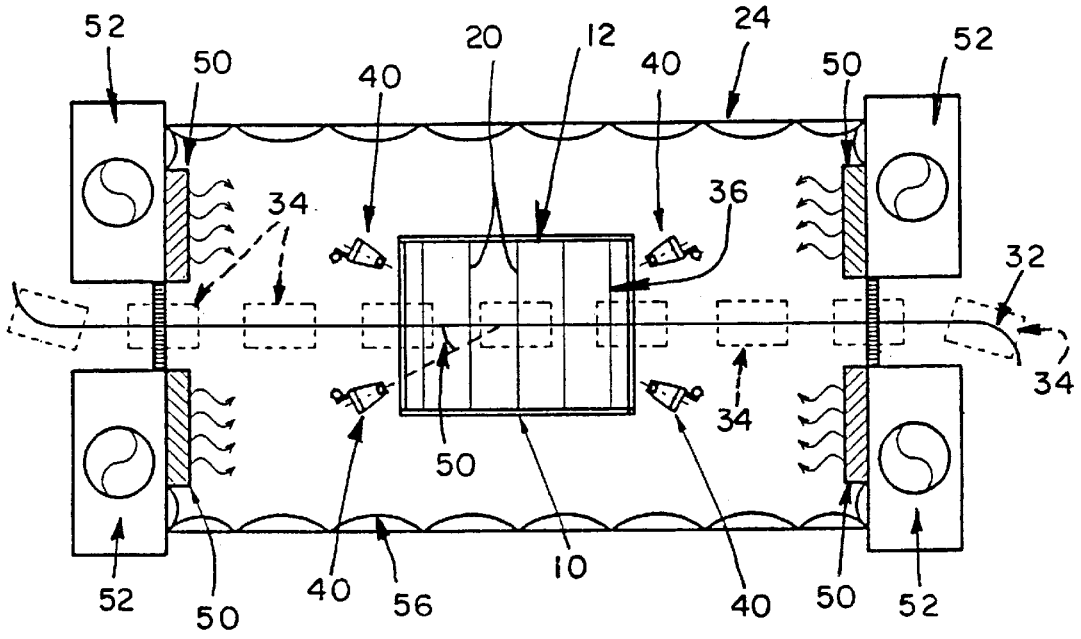
FIG. 3 illustrates a fragmentary top plan view of the system illustrated in FIGS. 1–2, taken generally along section lines 3—3 of FIG. 2.

The system illustrated in FIGS. 1–3 includes a resin frame 10 having a generally rectangular bottom frame member 12 joined along its lateral edges to generally rectangular side frame members 14. Small cross sectional area electrical conductors (not shown) are embedded in the resin frame members 12, 14. The frame 10 is suspended from overhead by electrically non-conductive standoffs 18 which may be constructed from the same resin as frame members 12, 14 or from any other suitable non-conductive material. Electrical conductors 20, which illustratively are 0.08 mm diameter steel wires, extend across each of the rectangular frame members 12, 14 and are joined electrically to the conductors embedded in the frame members 12, 14. High-magnitude potential sources 22, such as, for example, sources of the type described in U.S. Pat. Nos. 4,485,427 and 4,745,520, are mounted on one or more of standoffs 18 and the output terminals of these sources 22 are joined electrically to conductors 20, illustratively through the conductors embedded in frame members 12, 14. The frame 10 and associated components typically will be mounted within a coating material application booth 24 which confines overspray from the coating operation generally to the booth 24 volume. The illustrated booth 24 has a slot 26 which extends longitudinally along the top 28 thereof. Hangars 30 extend through slot 26 from an overhead conveyor 32 into booth 24 and support articles 34, illustrated in broken lines in FIGS. 2–3 for the purpose of clarity, to be coated in booth 24 for conveyance through booth 24. Hangars 30 convey articles 34 through the space 36 defined between frame side members 14 and above frame bottom member 12. The conveyor 32, hangars 30 and articles 34 are in electrical contact with each other and are typically maintained at ground potential. When sources 22 are operating, they maintain the high magnitude potential difference across the conductor 20-to-article 34 space 36.

Coating dispensing devices 40 are positioned around the booth 24 at appropriate locations to atomize coating material from one or more sources 42 and to direct this atomized coating material into the space 36. Devices 40 and sources 42 are coupled to ground so that conductive, for example, water-base, coating materials can be supplied from sources 42 and atomized by devices 40 without the need for systems of the types described in any of U.S. Pat. Nos.: 1,655,262; 2,673,232; 3,098,890; 3,291,889; 3,360,035; 4,020,866; 3,122,320; 3,893,620; 3,933,285; 3,934,055; 4,017,029; 4,275,834; 4,313,475; 4,085,892; 4,413,788; 4,878,622; 4,982,903; 2,960,273; 3,393,662; 3,408,985; 3,937,401; 4,343,828; 4,347,984; 4,489,893; 4,555,058; 4,589,597; 4,771,949; 4,852,810; 4,872,616; 4,955,960; 4,989,793; and, 5,044,564; British Patent Specification 1,478,853; British Patent Specification 1,393,313; German Published Patent Application 3,600,920; or, Soviet Union Published Patent Document 1,098,578.

Ions flow continuously across the space 36 between conductors 20 and articles 34 as long as sources 22 are energized and properly grounded articles 34 are in the space 36. Atomized coating material from devices 40 projected into space 36 is charged by this ion stream and, as a result of this charge, is conveyed toward the grounded articles 34 to coat them.

Booth 24 can include appropriate filtration 50 and air moving equipment 52 to promote the movement of overspray from space 36 through the filtration equipment 50 for recovery and, under appropriate circumstances, reuse. Where appropriate, booth-cleaning aids 56 as described in copending U.S. Ser. No. 07/722,092, titled Powder Application Booth Liner and Method of Making It, filed Jun. 27, 1991, and assigned to the same assignee as this application, can be employed in booth 24.

In the tests, the results of which are described hereinafter, (a) DeVilbiss model AGGS-511-14FY high volume, low pressure automatic spray device(s) 40 was (were) employed. The air nozzle(s) was (were) the 14X nozzle(s) available for this (these) device(s). The coating material was Coating & Chemical Corporation #44538 waterborne pebble tan adjusted for a viscosity of 20 sec. (Zahn #3 cup), and a conductivity of 0.002 MΩ as measured on the A scale of a Ransburg 70367-00 ohmmeter. The coating material supply system included (a) Ransburg model 9966-01 DC pump(s) 48. Coating material delivery rate was about 200 $cm^3$/min per dispensing device 40. The conveyor 32 speed was 20 feet (about 6.1 m)/min. The power supply 22 for maintaining electrostatic potential on the conductor 20 grid was a Ransburg model 20593/18100 power supply control and transformer. Unless otherwise specified, it maintained a 90 KV potential across the grid-to-ground space 36 (grid negative) with no articles 34 in the space 36. This potential difference dropped to 82 KV with targets 34 being conveyed through the space 36. The grid drew 400 $\mu$A with no targets 34 in space 36. The grid current increased to 800–850 $\mu$A when coating material was being sprayed onto targets 34 as the targets 34 were being conveyed through the space 36. The targets 34 being coated were 1 inch (about 2.5 cm) diameter metal tubes four feet (about 1.2 m) in length suspended from conveyor 32 approximately 3 inches (about 7.6 cm) apart on centers.

Except as otherwise specified, the angle 50 (FIG. 3) between the conveyor 32 (the line of motion of the targets 34 through the space 36) and the spray axis (axes) of the nozzle(s) was 15 degrees or 30 degrees, as indicated. The minimum distance between the nozzle(s) and the line of motion was 9 inches (about 22.9 cm) or 12 inches (about 30.5 cm), as indicated. The spacing between the targets 34 and the side frame members 14 was 18 inches (about 45.8 cm). The spacing between the targets 34 and the bottom frame member 12 was 12 inches (about 30.5 cm). The side frame members 14 were 60 inches (about 1.5 meters) by 60 inches. The bottom frame member 12 was 60 inches by 37 inches (about 94 cm).

Figure 4:
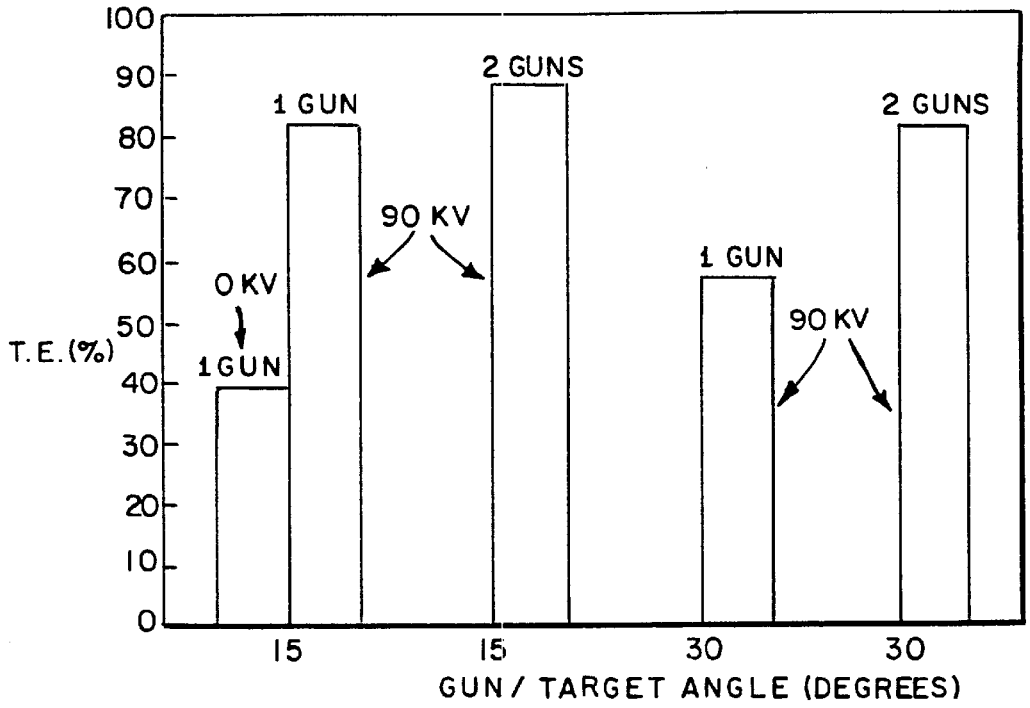
FIGS. 4–5 illustrate transfer efficiencies versus angles of dispensing device axis-to-line of motion of articles to be coated by dispensed coating material through a system constructed according to the invention.

Transfer efficiency is the mass of coating material adhering to the targets 34 divided by the mass of dispensed coating material times 100%. Transfer efficiency versus dispensing device 40 nozzle axis-to-line of motion angle 50 for angles of 15° and 30°, for one and two dispensing devices 40, and for conductor 20-to-ground voltages of zero volts and 90 KV with no targets 34 in the space 36 is illustrated in FIG. 4. As these data illustrate, transfer efficiencies increase markedly with applied voltage, increase somewhat with decreased angle 50 (at least as between 15° and 30°) and increase slightly as the number of dispensing devices 40 increases from one to two.

Figure 5:
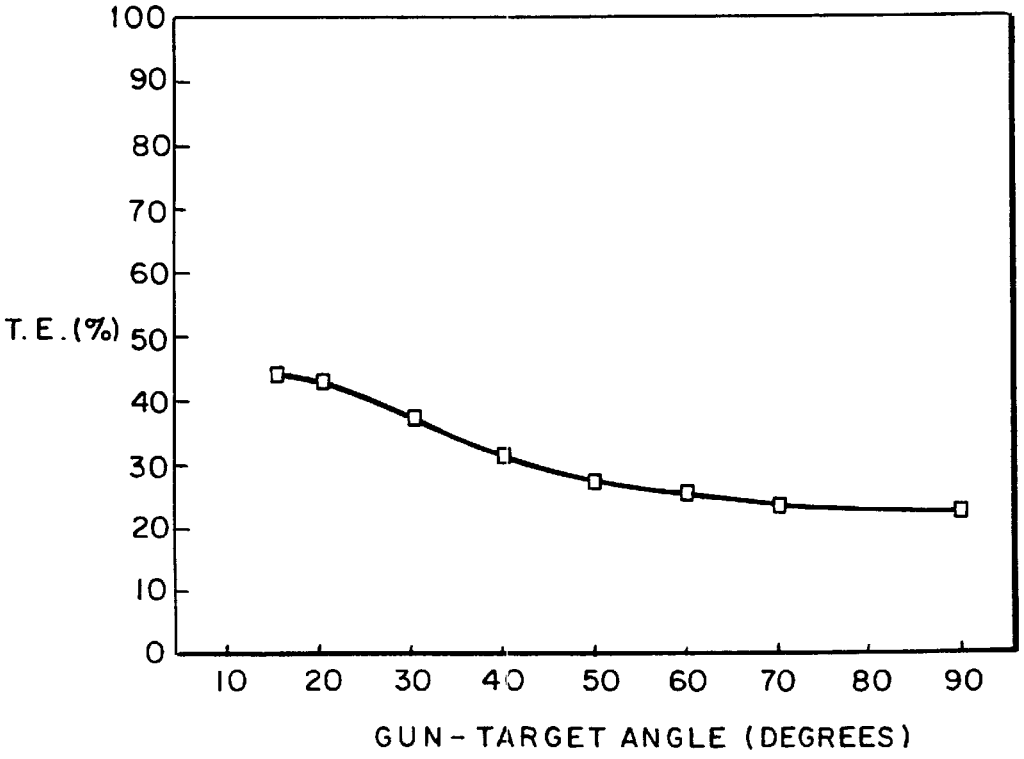

FIG. 5 illustrates the effects of changing the angle 50 with no potential difference maintained across the conductors 20 to targets 34. These same data are summarized in the following Table 1.

TABLE 1

| DISPENSING DEVICE 40-TO-TARGET 34 LINE OF MOTION ANGLE--DEGREES | DISPENSING DEVICE 40-TO-TARGET 34 DISTANCE--INCHES (~CM) | TRANSFER EFFICIENCY--% |
|---|---|---|
| 15 | 34.8 (88.4) | 44 |
| 20 | 26.3 (66.8) | 43 |
| 30 | 18 (45.7) | 37 |
| 40 | 14 (35.6) | 31 |
| 50 | 11.7 (29.7) | 27 |
| 60 | 10.3 (26.2) | 25 |
| 70 | 9.6 (24.4) | 23 |
| 90 | 9 (22.9) | 22 |

The distances in the DISPENSING DEVICE 40-TO-TARGET 34 DISTANCE column in Table 1 are the distances from the dispensing device 40 nozzle to the line of motion, measured along the axis of the nozzle. Again, Table 1 and FIG. 5 demonstrate that transfer efficiency in this range of angles (15°–90°) increases with decreasing angle between the nozzle axis and the line of motion.

Figure 6B:
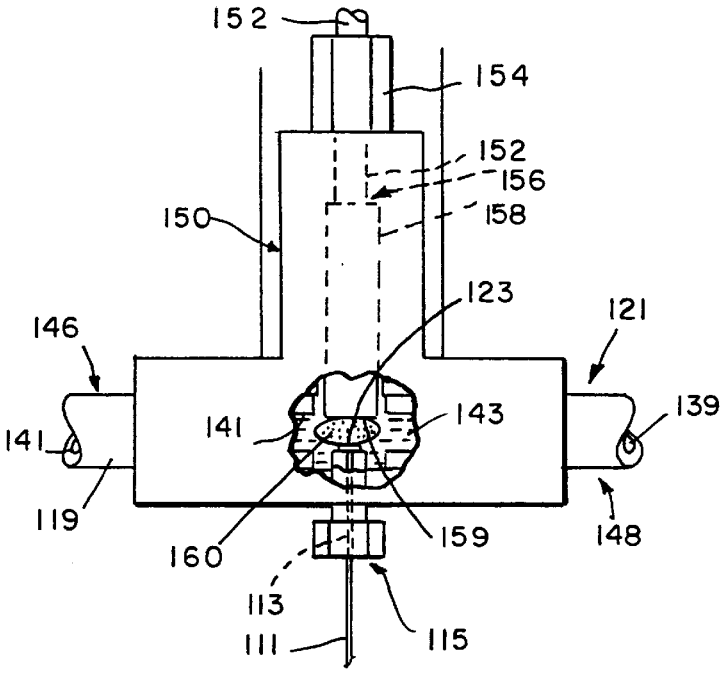
FIGS. 6*a–c* illustrate another embodiment constructed according to the present invention, with FIG. 6*a* illustrating a fragmentary side elevational view and FIGS. 6*b–c* illustrating enlarged side elevational views of details of FIG. 6*a;*
Figure 6A:
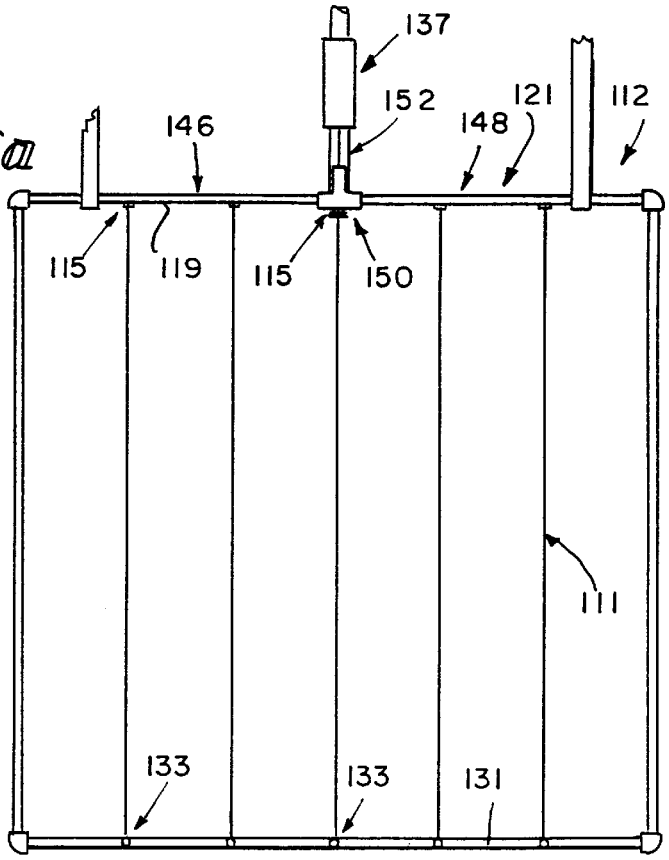
Figure 6C:
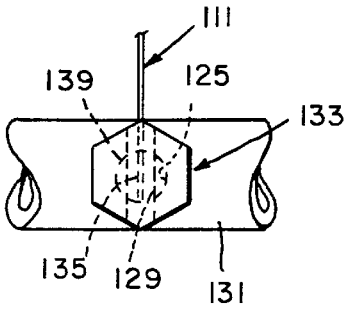

Another embodiment constructed according to the illustrated in FIGS. 6*a–c*. Generally square side frame members 112 are 180 cm on a side. 0.08 mm diameter conductors 111, in this embodiment, steel wires, spaced about 30 cm apart are tensioned by threading them through small diameter through holes 113 provided in upper bolts 115 which are threaded into openings 117 provided in the sidewall 119 of the upper resin frame member 121. The conductors 111 are terminated within the upper resin frame member 121 by crimping or tying metal end pieces 123 onto them to capture them outside the threaded ends of bolts 115. Intersecting threaded and unthreaded passageways 125, 129, respectively, are provided in the lower resin frame member 131 at the location of each of the conductor 111s' lower ends. Bolts 133 with transverse passageways 135 through their threaded regions 139 are threaded into threaded passageways 125 and receive the lower ends of conductors 111 through respective passageways 129 in lower frame member 131 and 135 in the bolts 133 themselves. Again conductors 111 can be captured in passageways 135 by crimping or tying metal end pieces onto the free ends of conductors 111 to prevent them from passing back through passageways 135. Conductors 111 can be tensioned as necessary by turning the upper bolts 115. Bolts 115, 133 are formed of non-conductive resinous materials, such as nylon.

Electrical contact is made from the power supply 137 and among the several conductors 111 as follows. The upper and lower frame members 121, 131 are constructed from an electrically non-conductive, e.g., nylon, polytetrafluoroethylene—PTFE (Teflon), poly(vinyl chloride)—PVC, or the like, tubing having an outside diameter of, illustratively, 2 cm and an inside diameter of illustratively, 1 cm. However, the inside wall surface 139 of frame member 121 is coated 141 with, or the inside of frame member 121 is filled 143 with, an electrically non-insulative material. In the former case, a metallized or carbon coating 141 of any of a number of known formulations can be provided on the inside of tube 121. In the latter case, any of a number of known fluid or fluid-like flowable materials, such as powdered carbons, powdered metals or the like, 143, can be used to fill tube 121.

Upper resin frame member 121 is actually constructed from two tubes 146, 148, each of which is approximately half of the length of member 121. Tubes 146, 148 are joined at a T connection 150. The third leg of the T connection 150 is provided with an entry for a high voltage cable 152 from supply 137 through a compression fitting 154 to a tack 156 through which electrical contact is made between the core conductor of high voltage cable 152 and one terminal of a resistor 158 in the range of 0–50 MΩ resistance. Contact can be made from the other terminal 159 of the resistor 158 through a piece of conductive foam 160 to the crimped metal on the upper end of the center conductor 111. Where a fluid 143 fills tube 121, contact can be made directly from terminal 159 to the fluid in tube 121.

A basic problem addressed by systems of this type is to increase current flow through the grid-to-target space without an attendant increase in the magnitude of the grid-to-target potential difference. There is a direct relationship between transfer efficiency and current flow through the grid-to-target space. There is also what might be characterized as a direct relationship between potential difference across the grid-to-target space and the likelihood of disruptive electrical discharge. The challenge, therefore, is to optimize the current flow/potential difference relationship.

Tests were conducted with conductor 111-to-target potential differences of 60 KV and 90 KV and conductor 111-to-target spacings of 30 cm, 46 cm and 61 cm, using wire 111 having 0.08 mm diameter and wire having 0.5 mm diameter. At the 60 KV wire-to-target potential the 0.08 mm wires demonstrated a 25% improvement in transfer efficiency at tested wire-to-target spacings over the 0.5 mm diameter wires. This confirms that the smaller diameter (0.08 mm) wires can be used to achieve 70%–80% transfer efficiencies at conductor-to-target potentials of only 60 KV. These results are illustrated in FIGS. 7*a* and *b*, the 90 KV (nominal) transfer efficiencies at the noted device-to-target spacings with 0.5 mm diameter wire (FIG. 7*a*) and 0.08 mm diameter wire (FIG. 7*b*), and FIGS. 8*a* and *b*, the 60 KV (nominal) transfer efficiencies at the noted device-to-target spacings with 0.5 mm diameter wire (FIG. 8*a*) and 0.08 mm diameter wire (FIG. 8*b*).

Figure 7A:
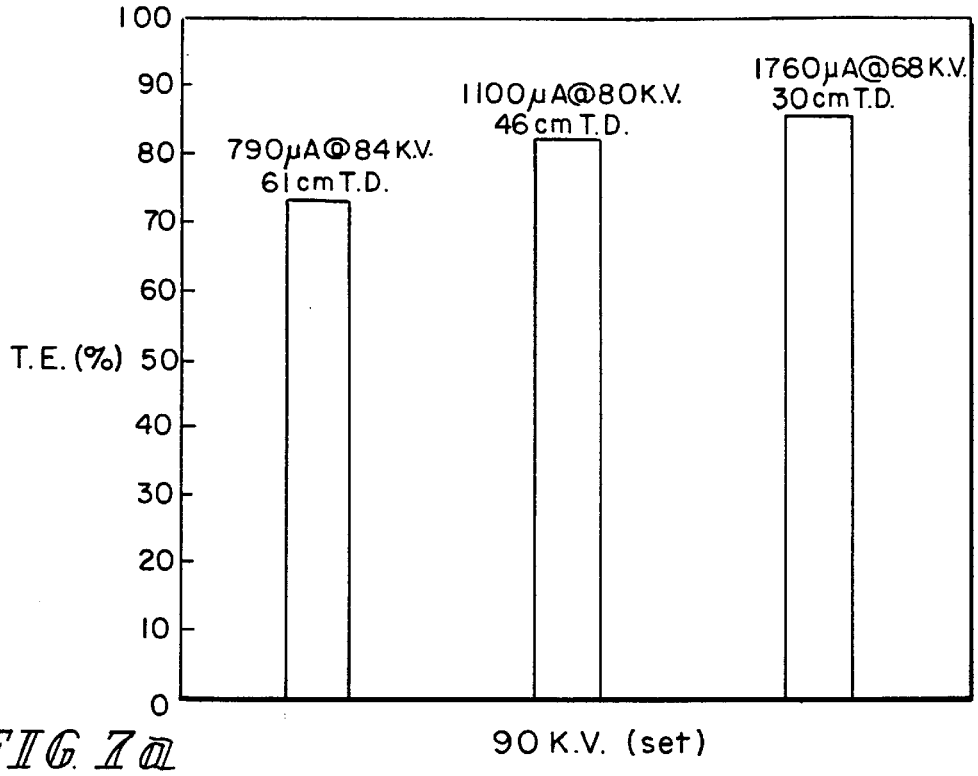
FIGS. 7*a–b* illustrate transfer efficiencies of the embodiment of FIGS. 6*a–c* with two different grid wire sizes.
Figure 7B:
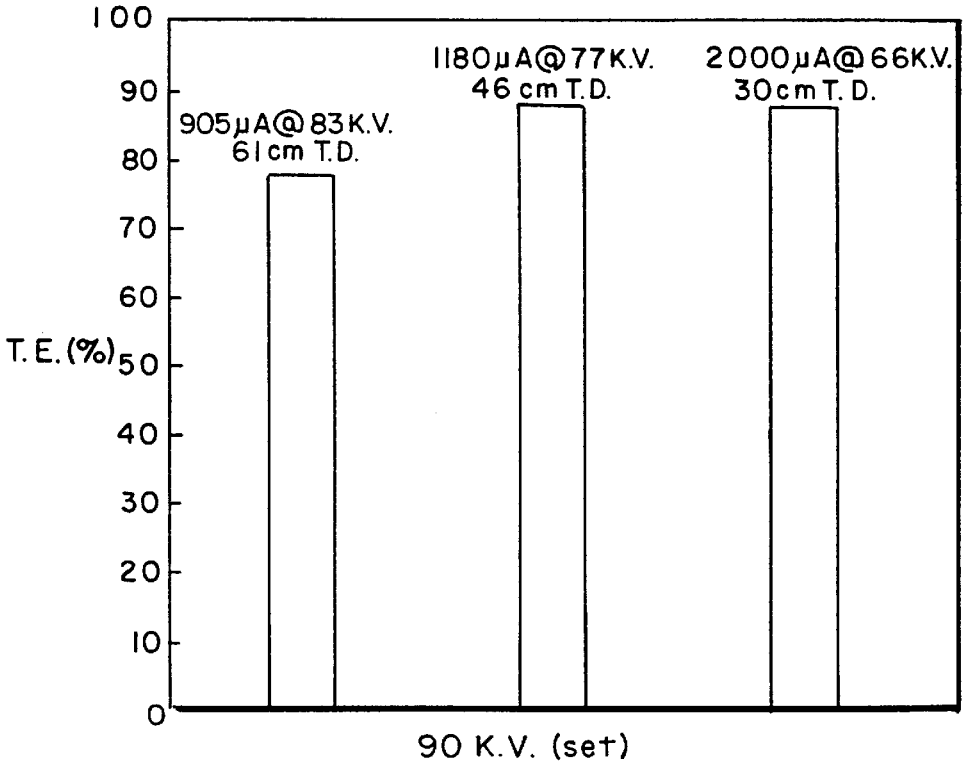
Figure 8A:
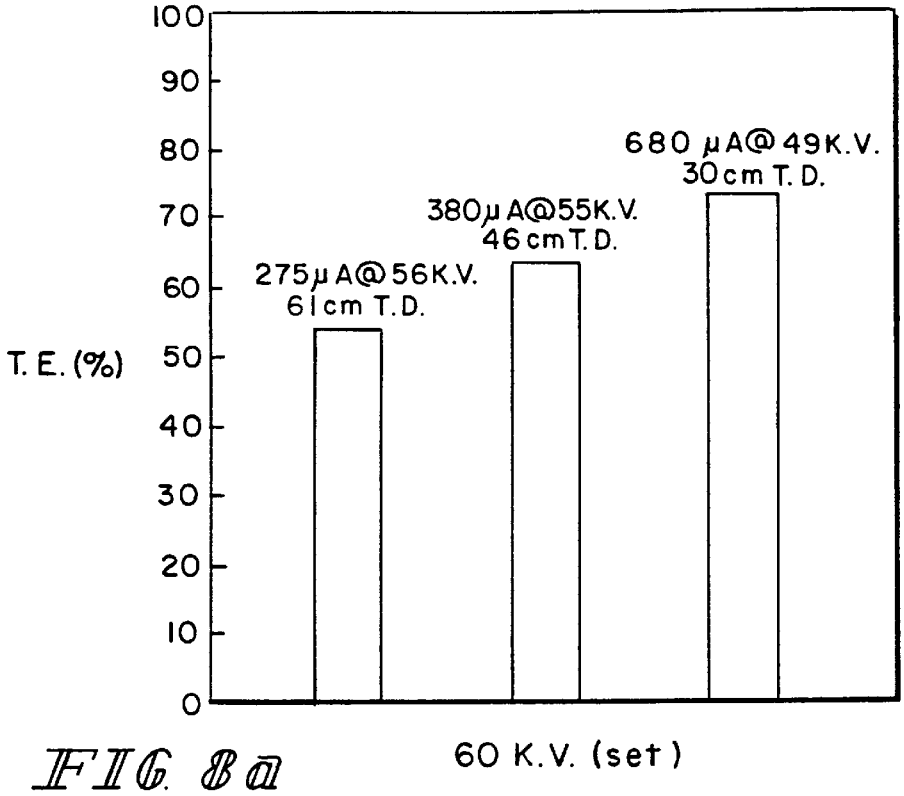
FIGS. 8*a–b* illustrate transfer efficiencies of the embodiment of FIGS. 6*a–c* with two different grid wire sizes.
Figure 8B:
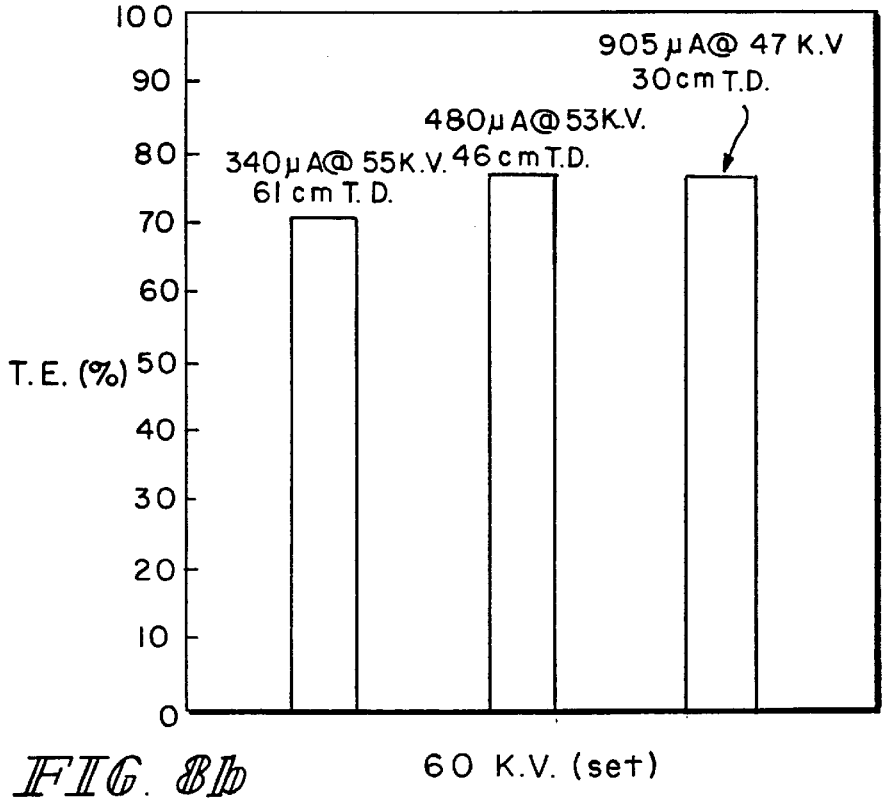

The nominal 90 KV and 60 KV potential differences in FIGS. 7*a–b* and 8*a–b* are the set potentials of the power supply. These potentials are reduced by the load current through the grid-to-target space as follows (200 $cm^3$/min. coating material feed rate). Referring particularly to FIG. 7*a*, at 90 KV nominal, 0.5 mm grid wire diameter, and 61 cm grid-to-target spacing, the potential difference across the grid-to-target space is 84 KV at a current of 790 μA. At 90 KV nominal, 0.5 mm grid wire diameter, and 46 cm grid-to-target spacing, the potential difference across the grid-to-target space is 80 KV at a current of 1100 μA. At 90 KV nominal, 0.5 mm grid wire diameter and 30 cm grid-to-target spacing, the potential difference across the grid-to-target space is 68 KV at a current of 1760 μA.

Referring particularly to FIG. 7*b* at 90 KV nominal, 0.08 mm grid wire diameter, and 61 cm grid-to-target spacing, the potential difference across the grid-to-target space is 83 KV at 905 μA. At 90 KV nominal, 0.08 mm grid wire diameter, and 46 cm grid-to-target spacing, the potential difference across the grid-to-target space is 77 KV at 1180 μA. At 90 KV nominal, 0.08 mm grid wire diameter, and 30 cm grid-to-target spacing, the potential difference across the grid-to-target space is 66 KV at 2000 μA.

Referring particularly to FIG. 8*a*, at 60 KV nominal, 0.5 mm grid wire diameter, and 61 cm grid-to-target spacing, the potential difference across the grid-to-target space is 56 KV at 275 μA. At 60 KV nominal, 0.5 mm grid wire diameter, and 46 cm grid-to-target spacing, the potential difference across the grid-to-target space is 55 KV at 380 μA. At 60 KV nominal, 0.5 mm grid wire diameter, and 30 cm grid-to-target spacing, the potential difference across the grid-to-target space is 49 KV at 680 μA.

Referring particularly to FIG. 8*b*, at 60 KV nominal, 0.08 mm grid wire diameter, and 61 cm grid-to-target spacing, the potential difference across the grid-to-target space is 55 KV at 340 μA. At 60 KV nominal, 0.08 mm grid wire diameter, and 46 cm grid-to-target spacing, the potential difference across the grid-to-target space is 53 KV at 480 μA. At 60 KV nominal, 0.08 mm grid wire diameter, and 30 cm grid-to-target spacing, the potential difference across the grid-to-target space is 47 KV at 905 μA.

These same results, along with approximate coating material pattern size (diameter) data and some comparison data for 0 KV (power supply high voltage turned off) are illustrated in the following Table 2. The dispensing device, coating material and delivery rate were as previously identified. The power supply was a Ransburg Model 20593/18100 power supply controller/transformer. The angle between the axis of the dispensing device nozzle and line of motion of the targets is 15°. The grid of FIGS. 6*a–c* with 0.08 mm diameter wires was used. Unless otherwise specified, the conveyor speed was about 0.03 m/sec.

At a power supply setting of 90 KV, the transfer efficiency at a 61 cm grid-to-target spacing is 77.9%. Current flow is 905 μA. The pattern diameter is approximately 67 cm. At the 90 KV power supply setting, the transfer efficiency at a 46 cm grid-to-target spacing is 87.7%. Current flow is 1180 μA. The pattern diameter is approximately 64 cm. At the 90 KV power supply setting, the transfer efficiency at a 30 cm grid-to-target spacing is 87.0%. Current flow is 2000 μA. The pattern diameter is 58 cm.

At a power supply setting of 60 KV, the transfer efficiency at a 61 cm grid-to-target spacing is 70.7%. Current flow is 340 μA. The pattern diameter is approximately 73 cm. At the 60 KV power supply setting, the transfer efficiency at a 46 cm grid-to-target spacing is 77.1%. Current flow is 480 μA. The pattern diameter is 64 cm. At the 60 KV power supply setting, the transfer efficiency at a 30 cm grid-to-target spacing is 76.8%. Current is 905 μA. The pattern diameter is 58 cm.

Transfer efficiencies for 0 KV (high voltage off) for two different dispensing device-to-line of conveyor motion angles and two different conveyor speeds are illustrated for comparison. At a conveyor speed of 0.01 m/sec., the 15° device-to-line of motion angle used for all of the high voltage-on examples, and a 23 cm dispensing device-to-target distance (measured along the dispensing device nozzle axis), the transfer efficiency is 31.6% and pattern diameter is 58 cm. At a conveyor speed of 0.05 m/sec., a 90° device-to-line of motion angle and a 23 cm dispensing device-to-target distance (measured along the dispensing device nozzle axis), the transfer efficiency is 22.4% and pattern diameter is 29 cm.

TABLE 2

| K.V. | (set) | 61 cm T.E. (%) | 61 cm Current (μA) | 61 cm Pattern (cm) | 46 cm T.E. (%) | 46 cm Current (μA) | 46 cm Pattern (cm) | 30 cm T.E. (%) | 30 cm Current (μA) | 30 cm Pattern (cm) |
|---|---|---|---|---|---|---|---|---|---|---|
| | 90 | 77.9 | 905 | 67 | 87.7 | 1180 | 64 | 87.0 | 2000 | 58 |
| | 60 | 70.7 | 340 | 73 | 77.1 | 480 | 64 | 76.8 | 905 | 58 |
| # | 0 | 31.6 | N/A | 58 | # .01 m/s conv. speed, 23 cm dispensing device-to-target distance | | | | | |
| * | 0 | 22.4 | N/A | 29 | * .05 m/s conv. speed, 90° dispensing device axis-to-line of motion angle, 23 cm dispensing device-to-target distance | | | | | |

Figure 9:
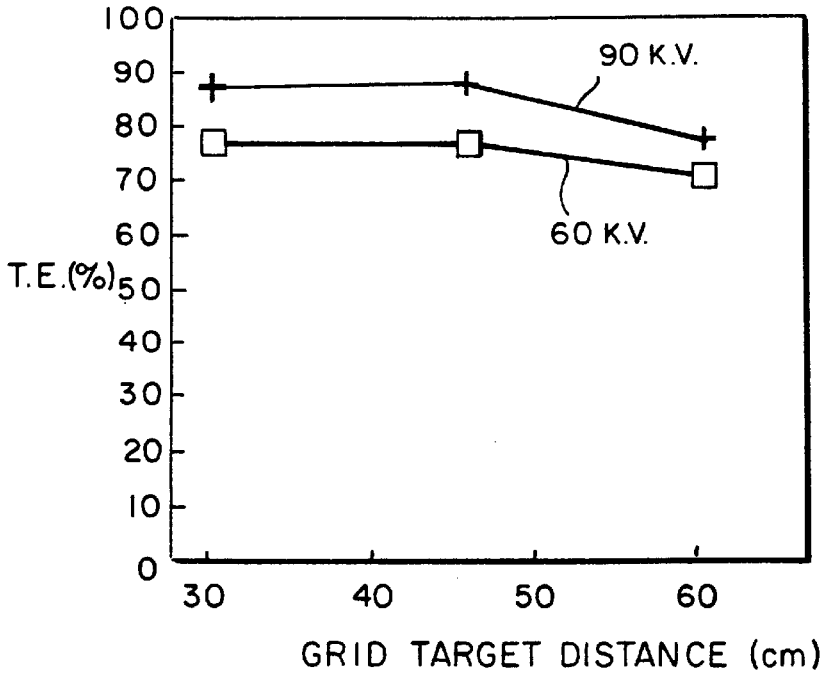
FIG. 9 illustrates graphs of transfer efficiency versus grid-to-target spacing of the embodiment of FIGS. 6*a–c;*

FIG. 9 illustrates graphs of transfer efficiency (in percent) versus grid-to-target spacing (in cm) for the grid of FIGS. 6*a–c* with 0.08 mm wire diameter for power supply settings of 60 KV and 90 KV.

Figure 10A:
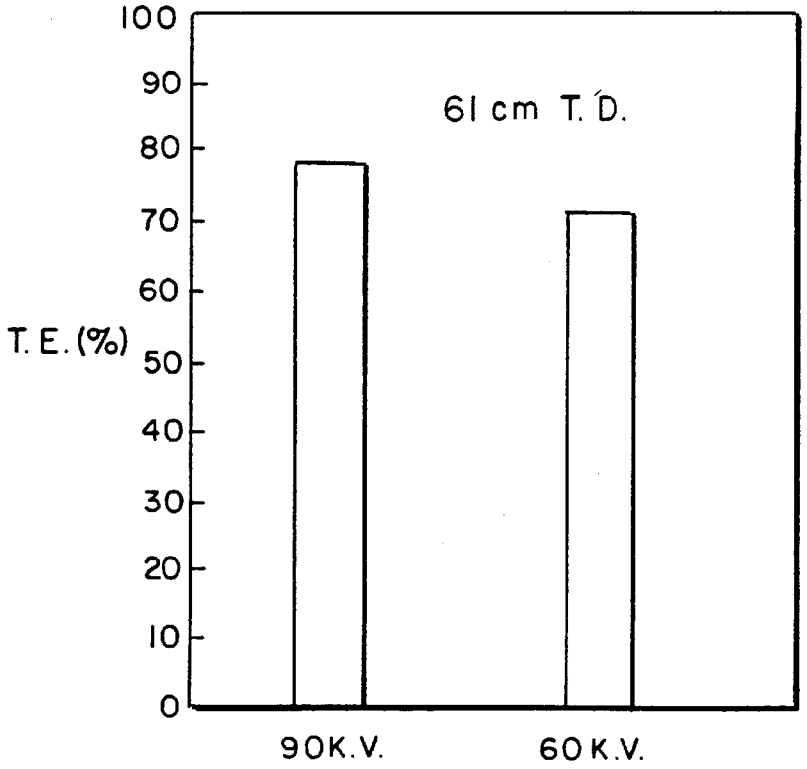
FIGS. 10*a–c* illustrate transfer efficiencies at two voltages for the embodiment of FIGS. 6*a–c;*

FIG. 10*a* illustrates transfer efficiencies at 60 KV and 90 KV at 61 cm grid-to-target spacing for the grid of FIGS.

Figure 10B:
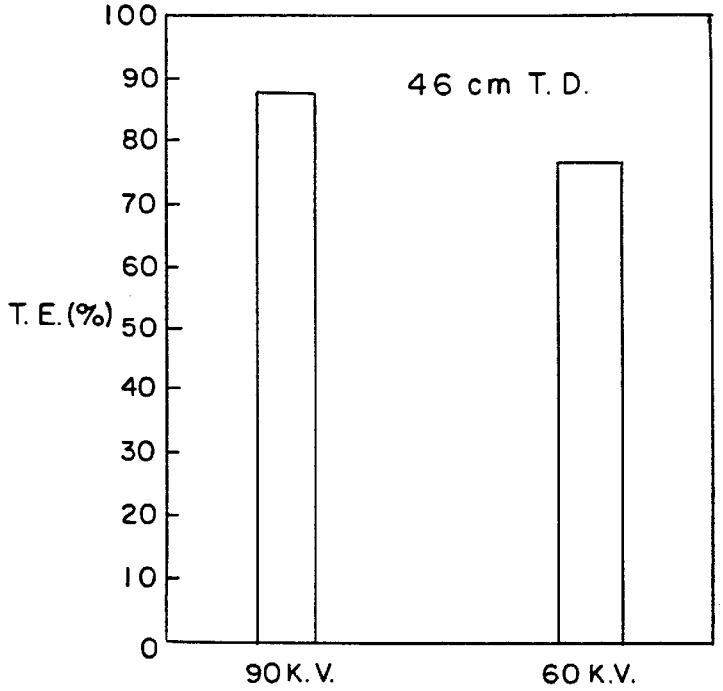
Figure 10C:
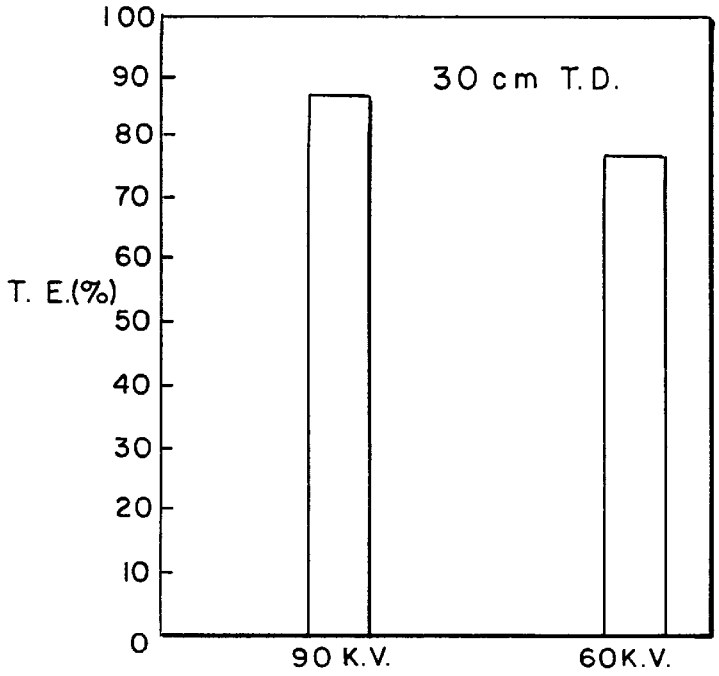

6*a–c* with 0.08 mm wire diameter. FIG. 10*b* illustrates transfer efficiencies at 60 KV and 90 KV at 46 cm grid-to-target spacing for the grid of FIGS. 6*a–c* with 0.08 mm wire diameter. FIG. 10*c* illustrates transfer efficiencies at 60 KV and 90 KV at 30 cm grid-to-target spacing for the grid of FIGS. 6*a–c* with 0.08 mm wire diameter.

Figure 11:
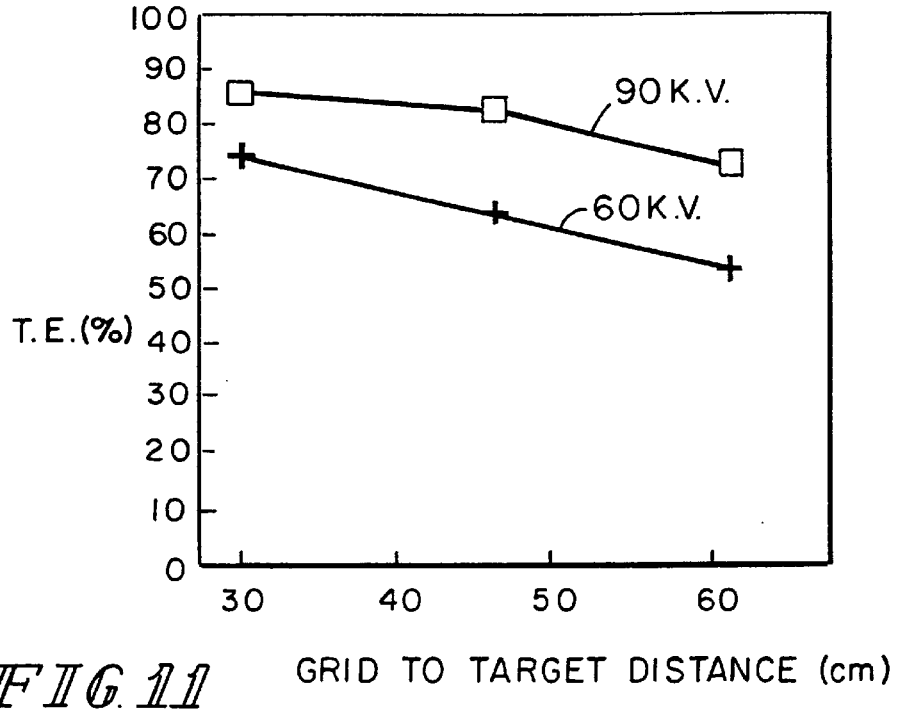
FIG. 11 illustrates graphs of transfer efficiency versus grid-to-target spacing of the embodiment of FIGS. 6*a–c;*

For purposes of comparison, the results with 0.5 mm diameter wire grid are illustrated in FIGS. 11 and 12*a–c*. FIG. 11 illustrates graphs of transfer efficiency (in percent) versus grid-to-target spacing (in cm) for the 0.5 mm diameter wire grid.

Figure 12A:
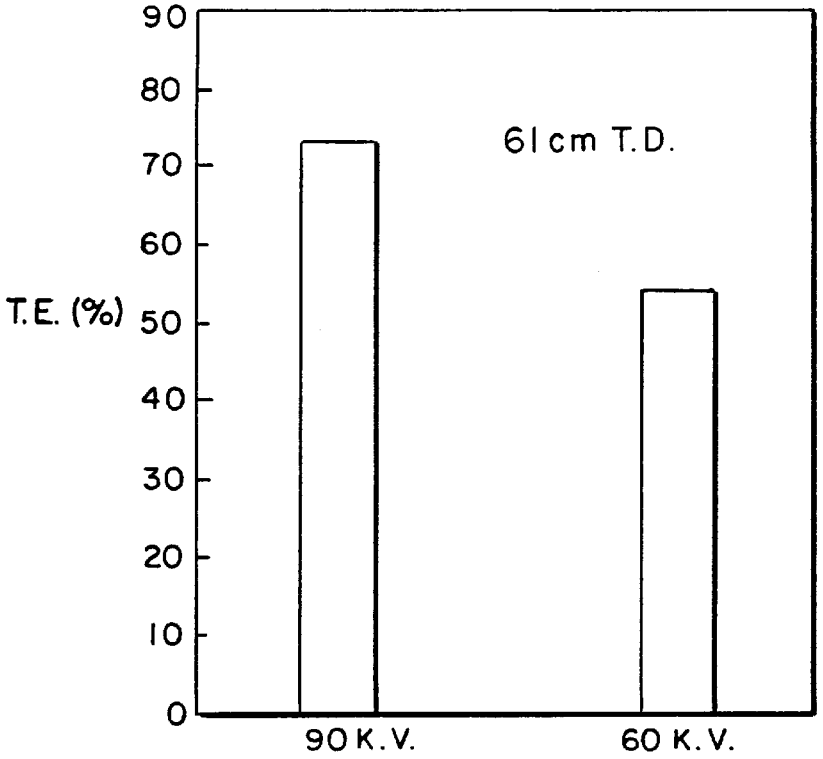
FIGS. 12*a–c* illustrate transfer efficiencies at two voltages for the embodiment of FIGS. 6*a–c;*
Figure 12B:
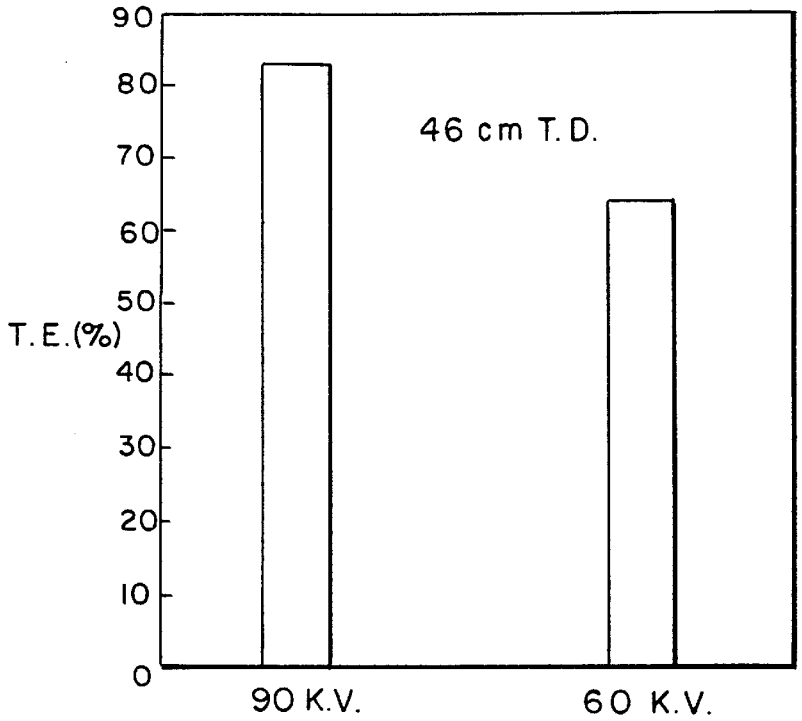
Figure 12C:
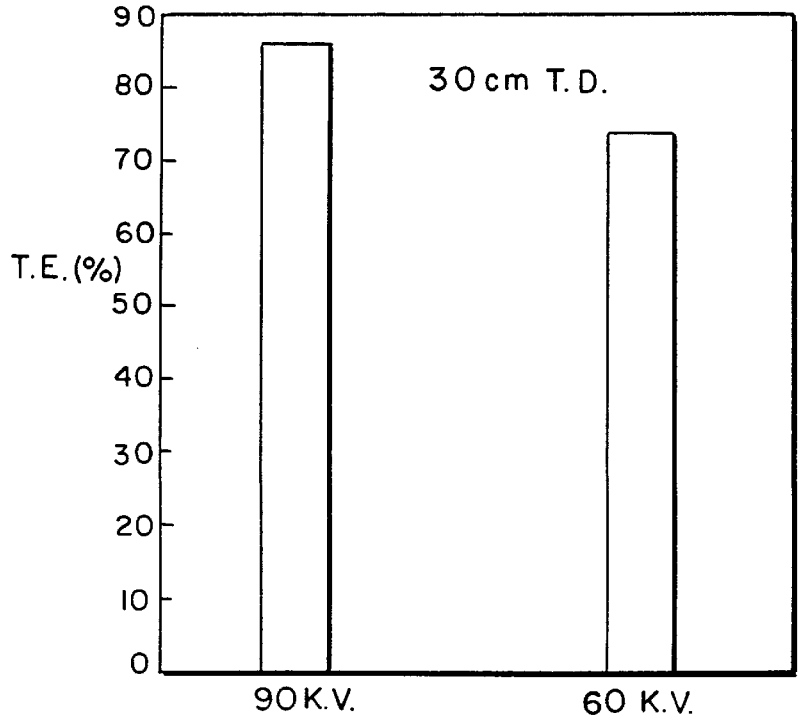

FIG. 12*a* illustrates transfer efficiencies at 60 KV and 90 KV at 61 cm grid-to-target spacing for this grid. FIG. 12*b* illustrates transfer efficiencies at 60 KV and 90 KV at 46 cm grid-to-target spacing for this grid. FIG. 12*c* illustrates transfer efficiencies at 60 KV and 90 KV at 30 cm grid-to-target spacing for this grid.

Table 3 illustrates these results. At a power supply setting of 90 KV, the transfer efficiency at a 61 cm grid-to-target spacing is 73.1%. Current flow is 790 μA. The pattern diameter is approximately 64 cm. At the 90 KV power supply setting, the transfer efficiency at a 46 cm grid-to-target spacing is 82.6%. Current flow is 1100 μA. The pattern diameter is approximately 64 cm. At the 90 KV power supply setting, the transfer efficiency at a 30 cm grid-to-target spacing is 85.6%. Current flow is 1760 μA. The pattern diameter is 67 cm.

At a power supply setting of 60 KV, the transfer efficiency at a 61 cm grid-to-target spacing is 53.8%. Current flow is 275 μA. The pattern diameter is approximately 63 cm. At the 60 KV power supply setting, the transfer efficiency at a 46 cm grid-to-target spacing is 63.7%. Current flow is 380 μA. The pattern diameter is 62 cm. At the 60 KV power supply setting, the transfer efficiency at a 30 cm grid-to-target spacing is 73.7%. Current is 680 μA. The pattern diameter is 63 cm.

In the examples illustrated in Table 3, the dispensing device, coating material, power supply, the angle between the axis of the dispensing device nozzle and the line of motion of the targets, the conveyer speed and delivery rate were as previously identified.

The transfer efficiencies 0 KV (power off) for the two different dispensing device-to-line of conveyor motion angles and two different conveyor speeds are repeated in Table 3 for comparison. At a conveyor speed of 0.01 m/sec., the 15° device-to-line of motion angle used for all of the high voltage-on examples, and a 23 cm dispensing device-to-target distance (measured along the dispensing device nozzle axis), the transfer efficiency is 31.6% and pattern diameter is 58 cm. At a conveyor speed of 0.05 m/sec., a 90° device-to-line of motion angle and a 23 cm dispensing device-to-target distance (measured along the dispensing device nozzle axis), the transfer efficiency is 22.4% and pattern diameter is 29 cm.

TABLE 3

| K.V. | (set) | 61 cm T.E. (%) | 61 cm Current (μA) | 61 cm Pattern (cm) | 46 cm T.E. (%) | 46 cm Current (μA) | 46 cm Pattern (cm) | 30 cm T.E. (%) | 30 cm Current (μA) | 30 cm Pattern (cm) |
|---|---|---|---|---|---|---|---|---|---|---|
| | 90 | 73.1 | 790 | 64 | 82.6 | 1100 | 64 | 85.6 | 1760 | 67 |
| | 60 | 53.8 | 275 | 63 | 63.7 | 380 | 62 | 73.7 | 680 | 63 |
| # | 0 | 31.6 | N/A | 58 | # .01 m/s conv. speed, 23 cm dispensing device-to-target distance | | | | | |
| * | 0 | 22.4 | N/A | 29 | * .05 m/s conv. speed, 90° dispensing device nozzle axis-to-conveyer line of motion angle, 23 cm dispensing device-to-target distance | | | | | |

FIGS. 13–16 illustrate graphs of coating material film thickness in microns versus distance in centimeters measured perpendicularly from the dispensing device nozzle axis with 0 cm being the nozzle axis. Negative (–) distances are those above the nozzle axis and positive distances are those below the nozzle axis. The horizontal broken line in each graph indicates 50% of the maximum measured film thickness. The horizontal solid line in each graph indicates the mean value of all plotted points. Except as otherwise noted, conditions are as previously set forth. In each case the fan (shaping) air flow rate for the dispensing device spray pattern is set to maximum.

Figure 13:
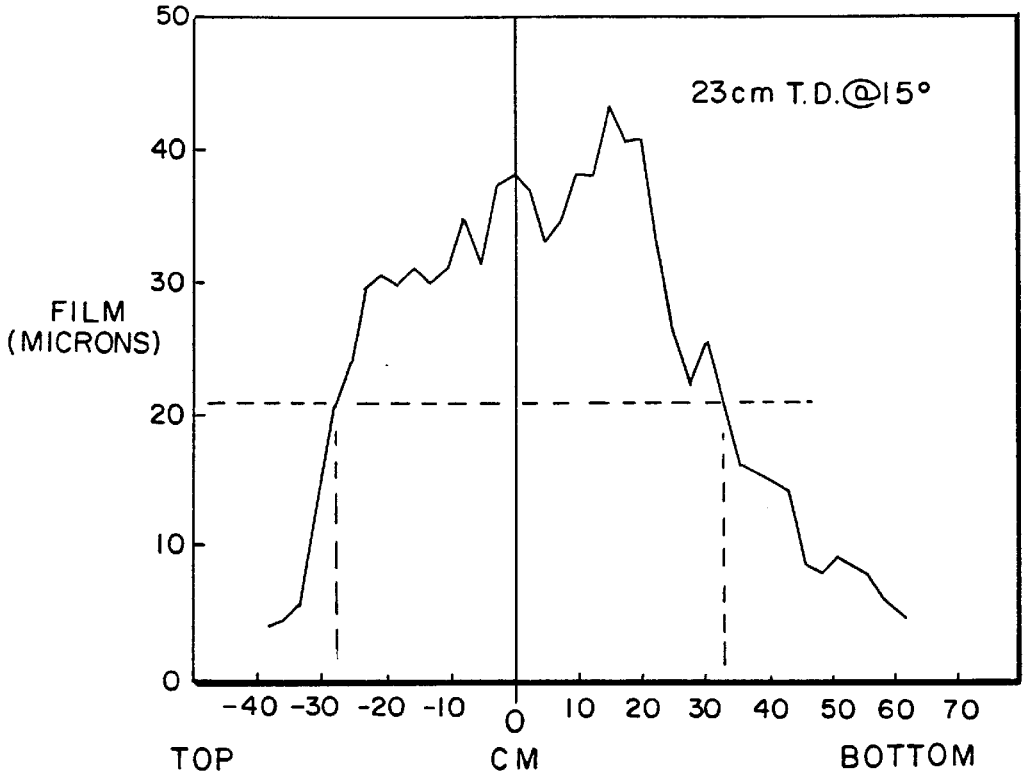
FIGS. 13–16 illustrate graphs of coating material film thickness versus distance from a dispensing device nozzle axis.

In FIG. 13, the grid-to-target potential difference is 0 KV (high voltage off). The conveyor speed is about 0.01 m/sec. The dispensing device-to-target distance is 23 cm (measured along the nozzle axis) and the dispensing device-to-conveyor line of motion angle is 15°. 45% of the film having a thickness greater than 50% of the maximum thickness lies above the dispensing device nozzle axis. 55% of the film having a thickness greater than 50% of the maximum thickness lies below the nozzle axis. The useable pattern width (between the broken vertical lines) is about 58 cm.

Figure 14:
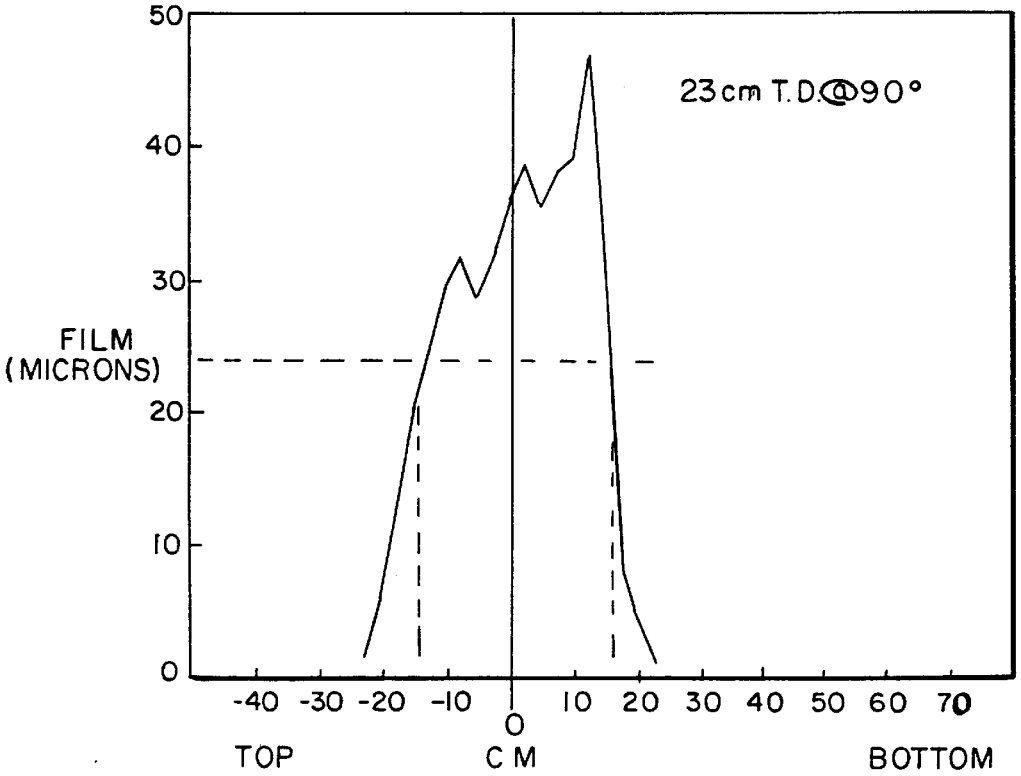

In FIG. 14, the grid-to-target potential difference is again 0 KV. The conveyor speed is about 0.05 m/sec. The dispensing device-to-target distance is 23 cm (measured along the nozzle axis) and the dispensing device-to-conveyor line of motion angle is 90°. Again 45% of the film having a thickness greater than 50% of the maximum thickness lies above the dispensing device nozzle axis and 55% lies below. However, the useable pattern width (between the broken vertical lines) is reduced to 29 cm, as noted in Tables 2 and 3.

Figure 15:
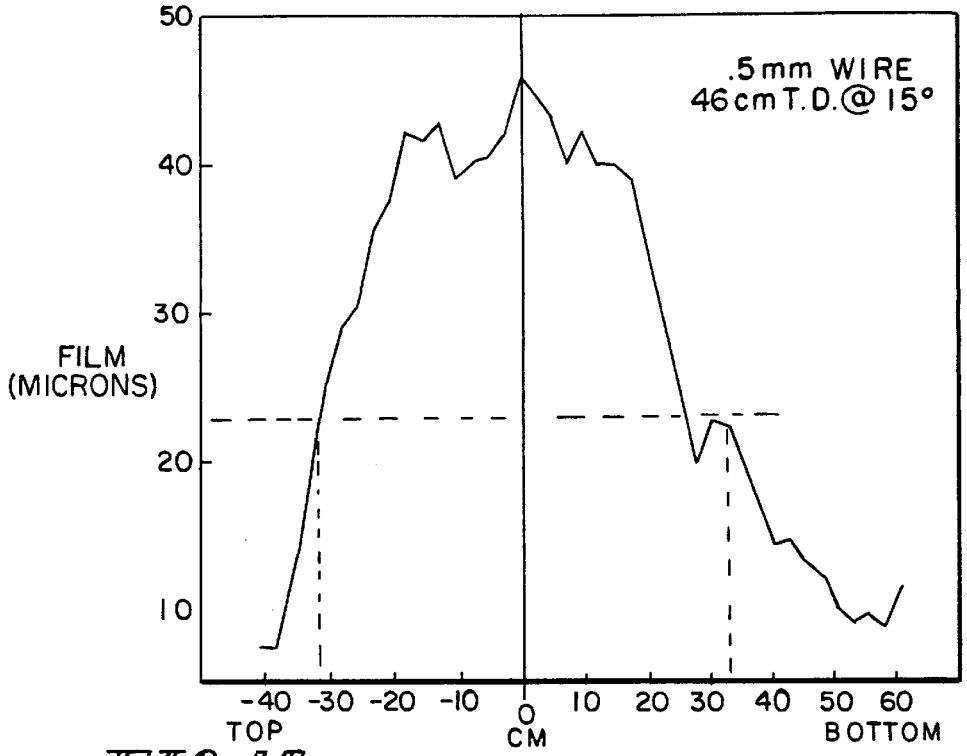

In FIG. 15, the film distribution using grids of FIGS. 6*a–c* with 0.5 mm diameter wires is illustrated. The grid-to-target potential difference is 90 KV. The conveyor speed is about 0.03 m/sec. The grid-to-target distance is 46 cm and the dispensing device-to-conveyor line of motion angle is 15°. 48% of the film having a thickness greater than 50% of the maximum thickness lies above the dispensing device nozzle axis and 52% lies below. The useable pattern width (between the broken vertical lines) increases to 64 cm.

Figure 16:
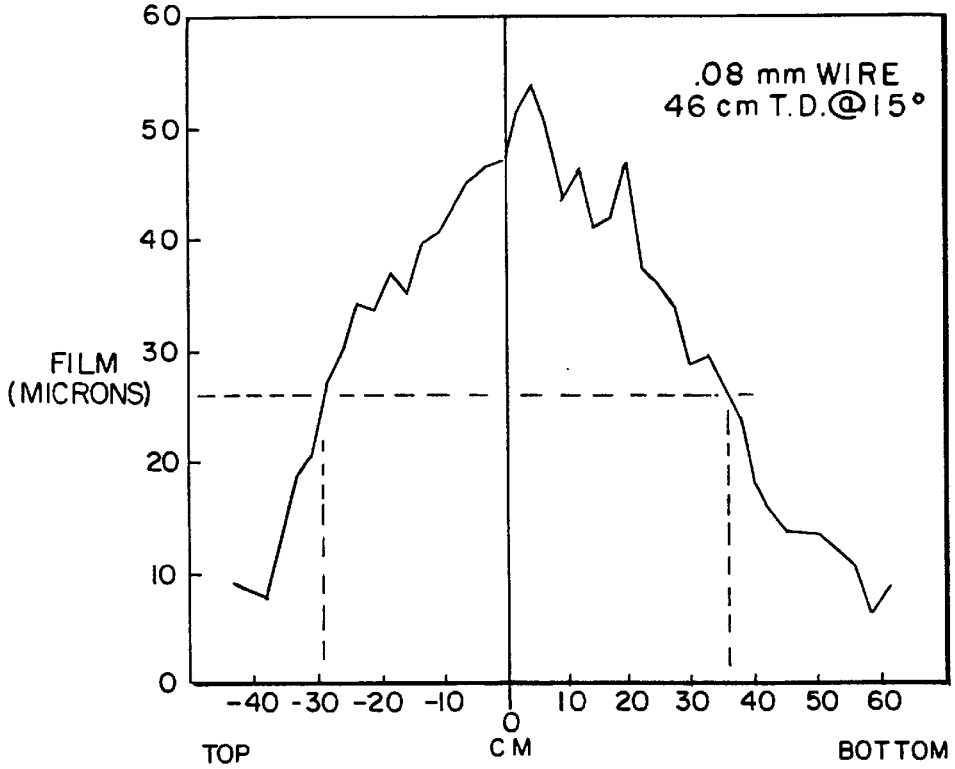

In FIG. 16, the film distribution using grids of FIGS. 6*a–c* with 0.08 mm diameter wires is illustrated. The grid-to-target potential difference again is 90 KV. The conveyor speed is about 0.03 m/sec. The grid-to-target distance is 46 cm and the dispensing device-to-conveyor line of motion angle is 15°. 44% of the film having a thickness greater than 50% of the maximum thickness lies above the dispensing device nozzle axis and 56% lies below. The useable pattern width (between the broken vertical lines) again is 64 cm.

It will be appreciated from these data that the reduction in wire diameter is achieved at no cost in useable pattern width and an improvement in transfer efficiency. At the same time, the load capacitance is reduced substantially. The reduction in conductive mass presented by replacing the 0.5 mm diameter grid by the 0.08 mm diameter grid in the system of FIGS. 6*a–c* represents about a 1.7 orders of magnitude improvement (reduction) in the conductive mass. Added to this, replacement of the prior art's conductive supporting framework by the non-conductive resin framework 12, 14 of FIGS. 1–3 and 112 of FIGS. 6*a–c* results in a further substantial reduction in the conductive mass being driven by the high magnitude potential supply. These reductions provide a dramatic reduction in the likelihood of disruptive electrical discharges from the grid during a coating operation, all without the need for voltage blocks when electrically conductive coatings are being dispensed.

Figure 17:
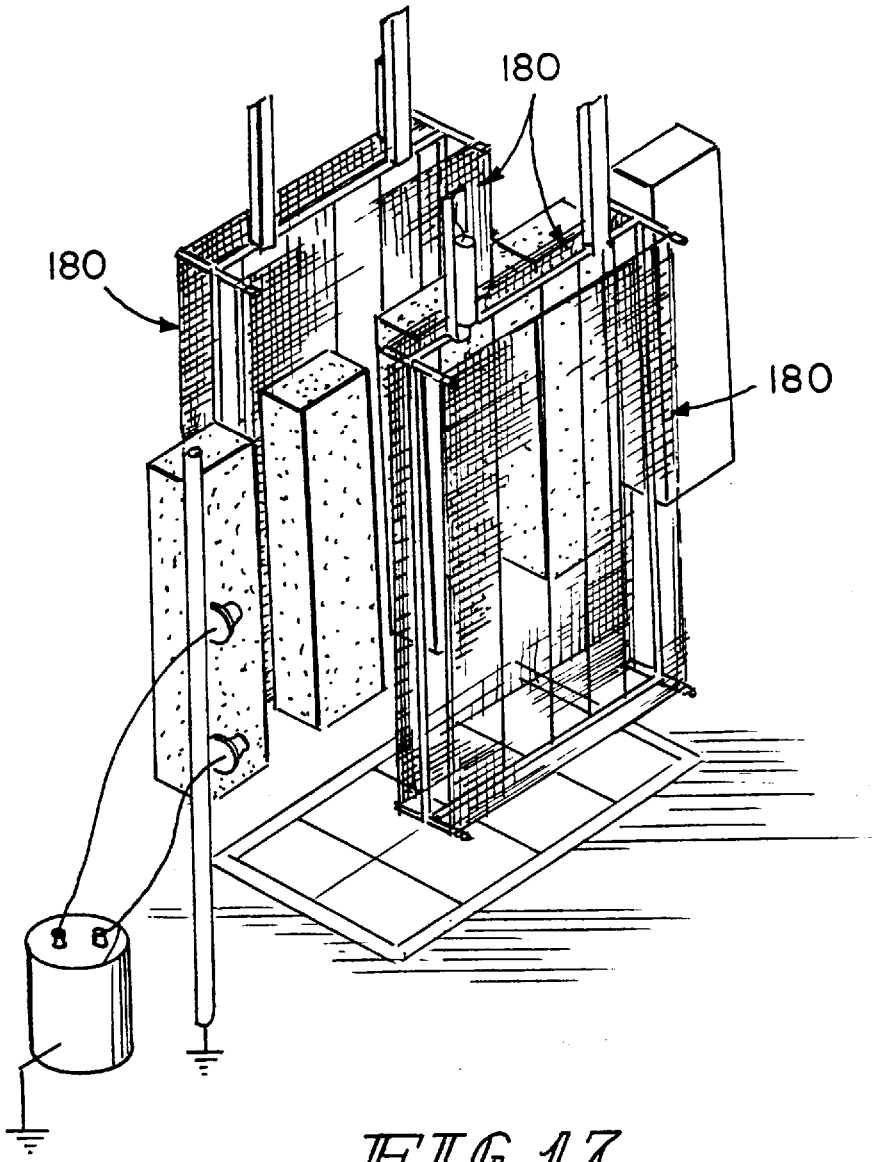
FIG. 17 illustrates a fragmentary perspective view of another system constructed according to the present invention.

Although discharge energy levels below 0.25 millijoule (a figure of merit for achieving so-called nonincendive status) were not achieved, the use of the 0.08 mm diameter wire grid powered by a cascade power supply and control circuitry, enabled avoidance of a hazardous spark to an approaching object to within a few centimeters of any of the grid wires. As a further improvement, a mesh screen 180 (FIG. 17) constructed of plastic can be mounted from side frame members 112 to lie between the charging grid and the articles 34 being coated to prevent a hazardous spark from occurring when a grounded object approaches the grid. Plastic screen 180 provides a means of avoiding incendive discharges, and also protects the grid electrode conductors 111 from damage from being struck by, for example, articles 34 swinging as they are being conveyed along the conveyor 32. Plastic screen 180 can be constructed from a variety of commercially available materials, such as, for example, PTFE-coated screen print dryer belt material available from Fluorglas Division of Allied-Signal Inc., P.O. Box 320, Hoosick Falls, N.Y. 12090-0320. The screen mesh size is not critical. Care should be taken, however, to select a mesh which is sufficiently open to maximize current flow from the grid wires to the grounded articles being coated. About ¼ inch (6.4 mm) square mesh is a suitable fineness. The choice of the material used in the construction of the mesh is broad. Any nonconductive fiber filament or other material that has reasonable solvent resistance and mechanical strength will suffice.

The conductors 20, 111 can also be constructed from, for example, a conductor such as fine wire coated with a non-conductor (for example, glass), or a non-conductor or a conductor coated with a semiconductive (for example, carbon/phenolic paint) coating can be employed to construct the grid. Tests indicate that the insulating layer surrounding the fine wire can reduce the discharge energy to less than 0.25 millijoule when the electrode surface comes into contact with, for example, a swinging grounded article being conveyed through the coating zone on the conveyor. Glass coated wire can be obtained from, for example, Galileo Electro-Optics Corp., Perrowville Road, Forest, Va. 24551. Semiconductive coatings can also be used to coat the surface of conductive wire and reduce discharge energy to less than the 0.25 millijoule figure of merit.

In another embodiment of this invention, semiconductive fibers, such a silicon carbide continuous fiber, can form the conductor 20, 111. Tests conducted on such semiconductive fibers indicate that discharge energies can be reduced to less than 0.25 millijoule with these electrodes as well. Such fibers are available from, for example, Nippon Carbon Co. Ltd., 6-1, Hatchobori 2-chome, Chuo-ku, Tokyo, Japan under its trademark NICALON®. However, a variety of filaments and yarns are available which have suitable mechanical, chemical and electrical properties.

Non-conductive monofilaments, such as, for example, fishing line, can be coated with a semiconductive carbon filled phenolic varnish. Suitable carbon coating formulations and application techniques are described in Table 4. Tests conducted employing the carbon formulations and coating methods outlined in Table 4 on monofilament fishing line indicate that energy discharges can be limited to less than the 0.25 millijoule figure of merit with this embodiment of the invention as well. The nylon monofilament is more robust than, for example, 0.08 mm diameter steel wire. Other semiconductive coatings and methods of treating the monofilament or nonconductive fibers to make them semiconductive can be used to achieve the same results as the coatings described in Table 4.

TABLE 4

SEMICONDUCTIVE CARBON COATING COMPARISON

| | | | |
|---|---|---|---|
| FORMULATION | | | |
| Carbon Powder, Carbolac. #2 By Cabot (discontinued) | 6.0% | Carbon Powder, FW1 By Degussa | 5.0% |
| Short Oil Alkyd, Blend 32272 By Perfection Paint | 59.0% | | |
| Phenolic, Methylon 75-108 By Specialty Resins Corp. | 35.0% | Phenolic, Bakelite BKS-7590 By Georgia-Pacific | 95.0% |
| MANUFACTURABILITY | | | |
| Method: | Ball mill | Method: | Ball Mill |
| Cure Cycle: | 250 degrees F. for 30 min. and 350 degrees F. for 4 hr. | Cure Cycle: | 320 Degrees F. for 1 hr. |
| Repeatability: | 75% | Repeatability: | 95% |
| APPLICATION METHOD | | | |
| | Dip and Screed With Leveling Device | Dip and Screed With Leveling Device | |
| SOLVENT SOAK | | | |
| Mechanical: | hardness - 9H pencil adhesion - satisfactory durability - satisfactory | Mechanical: | hardness - 9H pencil adhesion - satisfactory durability - satisfactory |
| Electrical: | open after 24 hour soak | Electrical: | no change after 24 hour soak |

Other useful materials for the conductors 20, 111 include salt water fishing lines having metal wire cores encased in filaments such as nylon monofilament. Such lines are available from, for example, Berkley Outdoor Technology Croup, One Berkley Drive, Spirit Lake, Iowa 51360, under the trademark STEELON. Thirty pound test is a suitable size. Another useful material for conductors 20, 111 is 1.5 mil (0.04 mm) wire, such as Moleculoy wire available from Molecu-Wire Corporation, Route 547, Wall Township, N.J. 07719. If the wire has sufficient strength, it can simply be stretched on the resin frame members 12, 14, 112. If not, the 1.5 mil (0.04 mm) wire can be wound on monofilament fishing line in a loose spiral (about one turn per three inches—7.6 cm—of length of fishing line). This way, the mass of the high-magnitude potential electrode is kept to a minimum while the necessary mechanical strength is provided by the fishing line. It may be desirable to coat the line after wrapping the wire around it with a thin coat of varnish to prevent displacement of the wire along, or unwinding of the wire from, the monofilament.

The various described elements can be combined to achieve the desired levels of mechanical (structural), chemical (solvent resistance), and electrical (energy discharge limits and charging efficiency) properties.

Another parameter investigated during testing was the effect of mounting the conductors 20, 111 horizontally rather than vertically. Although the conductors 20, 111 may be oriented in any direction and still achieve excellent charging characteristics and high transfer efficiency, it was noted that when the conductors 20, 111 wore strung horizontally, they tended to vibrate more through the influence of the electric field. This helped reduce coating buildup on the surfaces of conductors 20, 111.

Figure 18:
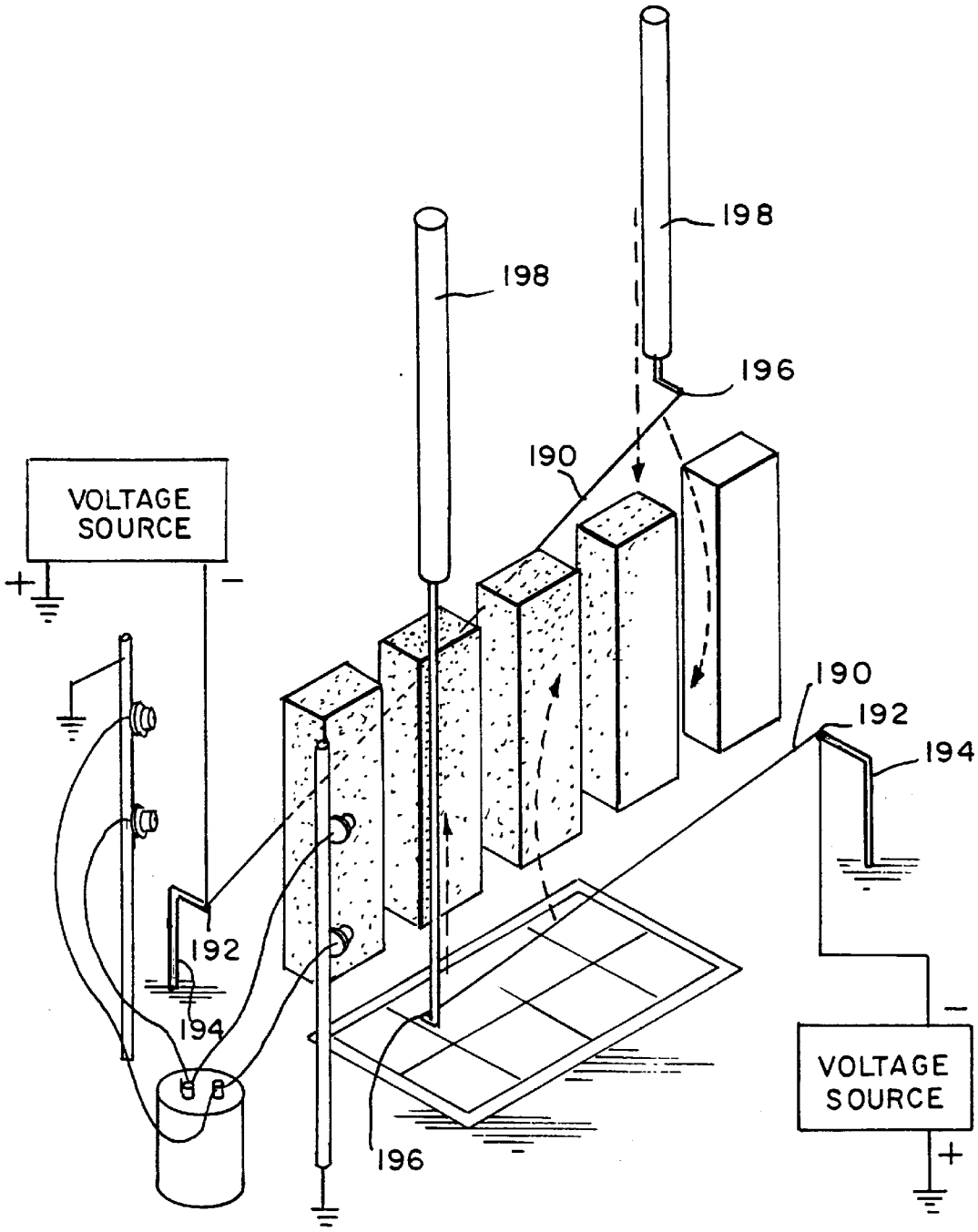
FIG. 18 illustrates a fragmentary perspective view of another system constructed according to the present invention.

Another parameter which was investigated was the use of an oscillating conductor in place of multiple stationary grid conductors 20, 111 on a frame. The single conductor 190 (FIG. 18) was anchored at one end 192 to an insulator 194 at the point at which high voltage was supplied to conductor 190. The other end 196 of conductor 190 was oscillated vertically or horizontally by, for example, a fluid motor 198, moving the conductor 190 in a plane parallel to a surface of the article 34 being coated. This approach reduced the total mass of conductor 190 at high voltage and therefore decreased the stored energy. The length of the oscillator 198 stroke was adjustable to tailor it to the requirements of the geometry(ies) of the article(s) 34 being coated.

The electric field strength of the field between a straight wire electrode and a surrounding concentric grounded conductive cylinder can be found from the equation, $$E=\sqrt{\frac{i}{2\pi\epsilon_o k}+\frac{r_o^2}{R_o^2}\left(E_c^2-\frac{i}{2\pi\epsilon_o k}\right)} \tag{1}$$

In equation 1, i is the electrode current (in A) per unit length (in m) which is obtained from the equation, $$V_c=r_oE_c\mathrm{Ln}\left(\frac{R_o}{r_o}\right)+r_oE_c\left(\sqrt{1+\frac{R_o^2 i}{2\pi\epsilon_o k r_o^2 E_c^2}}-1-\mathrm{Ln}\left(\frac{1+\sqrt{1+\frac{R_o^2 i}{2\pi\epsilon_o k r_o^2 E_c^2}}}{2}\right)\right) \tag{2}$$

where $V_c$=electrode voltage (in volts), $E_c$=critical electric field strength at the electrode surface= $2.0045\times10^7$ (in v/m), $r_o$=electrode radius (in meters), $R_o$=grounded cylinder radius (in meters), k=ion mobility ($\simeq1.75\times10^{-4}$ $m^2/v/s$), and $\in_o$=permittivity of free space ($=8.854\times10^{-12}$ F/m). Table 5 provides illustrative values for these variables.

TABLE 5

| $V_c$ (KV) | $r_o$ (mm) | $R_o$ (cm) | i ($\mu$A/meter) |
|---|---|---|---|
| 50 | .04 | 60 | 57.2 |
| 75 | .04 | 60 | 138 |
| 75 | .04 | 30 | 556 |
| 100 | .04 | 60 | 253.5 |
| 75 | .075 | 60 | 124 |
| 75 | .04 | 120 | 33.7 |
| 96.2 | .04 | 120 | 57.2 |

Equation 2 explains why reducing the diameter of the conductors 20, 111 increases corona discharge from conductors 20, 111, thereby increasing transfer efficiency. There will be a corona discharge as long as the electric field at the electrode surface is larger than $2.0045\times10^7$ v/m. In this case the electric field strength is given by equation 1.

There will be an arcing discharge as long as the electric field at the target surface (in this case the grounded cylinder surface) is larger than $3\times10^6$ v/m.

In the case where the electric field at the electrode surface is less than $2\times10^7$ v/m, or in the case of very small corona current (negligible space charge) the electric field strength is given by:

$$E=\frac{V_c}{L_n\left(\frac{R_o}{r_o}\right)}\cdot\frac{1}{r} \tag{3}$$

Where the electric field at the wire surface is less than $2\times10^7$ v/m and at the cylinder surface is greater than $3\times10^6$ v/m, there will be arcing without corona discharge. This condition requires that $$\frac{V_c}{R_o\mathrm{Ln}\left(\frac{R_o}{r_o}\right)}\geqq 3\times10^6 \text{ and}$$

$$\frac{V_c}{r_o\mathrm{Ln}\left(\frac{R_o}{r_o}\right)}\leqq 2\times10^7$$

or $r_o\geqq0.15\ R_o$ where $r_o$ is the wire radius and $R_o$ is the grounded cylinder radius.

The discharge energy from an electrode at high voltage to an approaching grounded conductor is given by:

$$W_{dis}=\frac{1}{2}\ C\ V_c^2 \tag{4}$$

where C is the capacitance and $V_c$ is the electrode voltage at the time the discharge is initiated. In equation 4, it is assumed that all the stored energy is discharged.

The capacitance C is a function of the electrode radius, the shape of the approaching conductor and the separation distance. In general, C is very complicated to calculate. Some formulas have been derived for a few simple cases. In the case of a wire electrode surrounded by a grounded cylinder, $$C = \frac{2\pi\epsilon_o}{\mathrm{Ln}\frac{R_o}{r_o}} l \tag{5}$$

where 1 is the length of the wire surrounded by the cylinder. This relationship establishes why the finer, smaller diameter wire grids provide lower capacitance loads to the power supplies.

When the grounded conductor is very far away, there will not be any discharge from the wire. As the grounded conductor is brought closer, the electric field gets stronger everywhere. However, it will always be higher at the wire electrode surface. When the electric field at that surface reaches $2\times10^7$ v/m, a corona discharge will start. As the conductor is brought closer, the electric field strength and the corona current will increase, producing an additional increase in the electric field strength. The net rate of the increase will be higher at the grounded conductor surface. An arcing discharge will start when the electric field strength at the grounded conductor surface reaches $3\times10^6$ v/m. The energy associated with such a discharge is related to the capacitance between the wire electrode and grounded surface at the moment of discharge.

In the case of a wire electrode surrounded by a grounded cylinder, the later can simulate an approaching conductor if it is assumed to have a decreasing radius. The separation distance becomes the cylinder radius. However, in this case, because the cylinder surrounds the wire electrode perfectly from all sides, the resulting capacitance is much higher than any practical case of a conductor approaching from one direction only. The value from equation 5 can be considered an extreme upper limit. The question becomes, "For a given approaching conductor of a size described by the length 1 and for a wire electrode of radius $r_o$ what is the value of $R_o$ for which the capacitance must be calculated?" It was noted above that it should be the value at which the electric field at the surface of the cylinder is $3\times10^6$ v/m. This can be calculated from equation 1 by replacing r by $R_o$ and calculating $R_o$ in terms of $r_o$ and i. In equation 2, $E=3\times10^6$ v/m, $E_c=2\times10^7$ v/m, $r_o$ is the wire electrode radius, $\in_o=8.854\times10^{-12}$ F/m, and $k=1.75\times10^{-4}$ $m^2$/v/s. The value of i will be calculated from equation 2 in terms of $V_c$, $r_o$, $E_c$ and $R_o$ for which $R_o$ must be given. Values of $R_o$ are tested until a value satisfying both equations 1 and 2 is found. In practice, the problem is easy to solve because in equation 1 only the first term under the square root symbol is significant. This equation can thus be simplified to express the electric field at the cylinder surface as $$E \simeq \sqrt{\frac{i}{2\pi\epsilon_o k}} \tag{6}$$

The corona current just prior to arcing discharge can be calculated from equation 6 to be $$i=2\ \pi\in_o k(3\times10^6)^2=0.0876A/m$$

or about 3.5 mA from a section of wire and approaching grounded conductor that are 4 cm long. This value can be substituted into equation 2 to calculate $R_o$ in terms of $V_c$ and $r_o$.

Table 6 illustrates the corresponding values of $R_o$, C and $W_{dis}$ for values of $V_c$ of 50 KV and 100 KV and values of $r_o$ of 0.04 mm and 0.08 mm at which arcing will be initiated. The electric field at the surface of the cylinder was calculated as $$E \simeq \sqrt{\frac{i}{2\pi\epsilon_o k}}$$

(equation 6).

Arcing is initiated when $i\simeq0.876$ A/m. Then $R_o$ was calculated from equation 2. In table 6, the common length of the wire and the cylinder was assumed to be 4 cm.

TABLE 6

| VC | $r_o$ | .04 mm | .08 mm |
|---|---|---|---|
| 50 KV | | $R_o$ = 16.3 mm | $R_o$ = 15.86 mm |
| | | C = .37 pf | C = .42 pf |
| | | $W_{dis}$ = .46 mj | $W_{dis}$ = .526 mj |
| 100 KV | | $R_o$ = 33 mm | $R_o$ = 32.6 mm |
| | | C = .33 pf | C = .37 pf |
| | | $W_{dis}$ = 1.65 mj | $W_{dis}$ = 1.86 mj |

In the case in which an approaching electrode of a certain shape does not generate a high corona current, a smaller electric field results for the same separation distance. In such a case, arcing will take place at a smaller separation distance than those displayed in Table 6. In the extreme case in which corona current is not generated before arcing the arcing distance can be calculated from equation 7:

$$R_o\mathrm{Ln}\frac{R_o}{r_o} = \frac{V_c}{3\times10^6} \tag{7}$$

In such a case, Table 7 illustrates the corresponding values of $R_o$, C and $W_{dis}$ in terms of $V_c$ and $r_o$. The values of $R_o$ were calculated from equation 7. In this table the common length of the wire and the cylinder was assumed to be 4 cm.

TABLE 7

| VC | $r_o$ | .04 mm | .08 mm |
|---|---|---|---|
| 50 KV | | $R_o$ = 3.61 mm | $R_o$ = 4.2 mm |
| | | C = .492 pf | C = .562 pf |
| | | $W_{dis}$ = .616 mj | $W_{dis}$ = .7 mj |
| 100 KV | | $R_o$ = 6.6 mm | $R_o$ = 7.37 mm |
| | | C = .436 pf | C = .492 pf |
| | | $W_{dis}$ = 2.18 mj | $W_{dis}$ = 2.46 mj |

Figure 19:
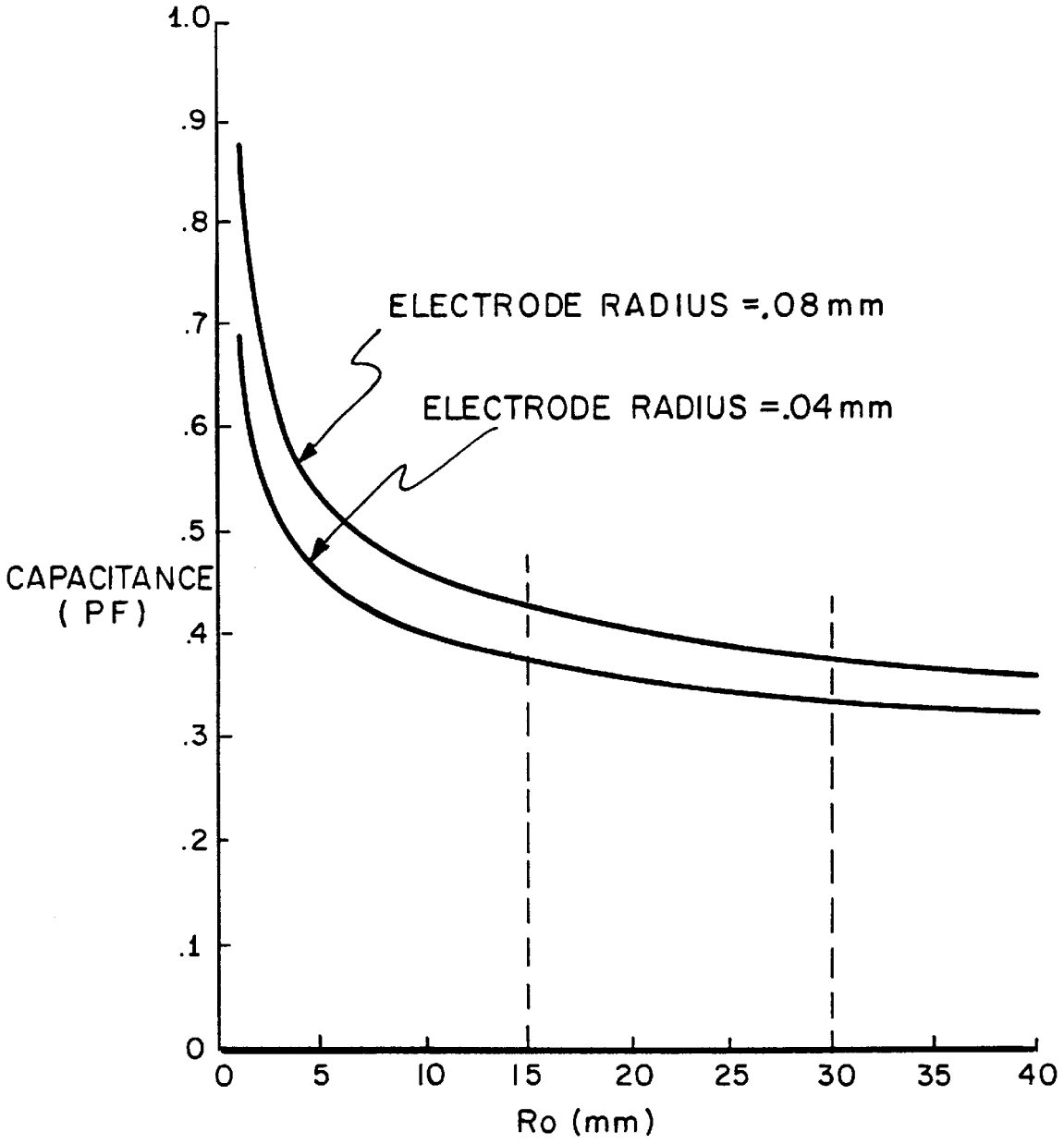
FIG. 19 illustrates a plot of capacitance versus cylinder radius.
Figure 20A:
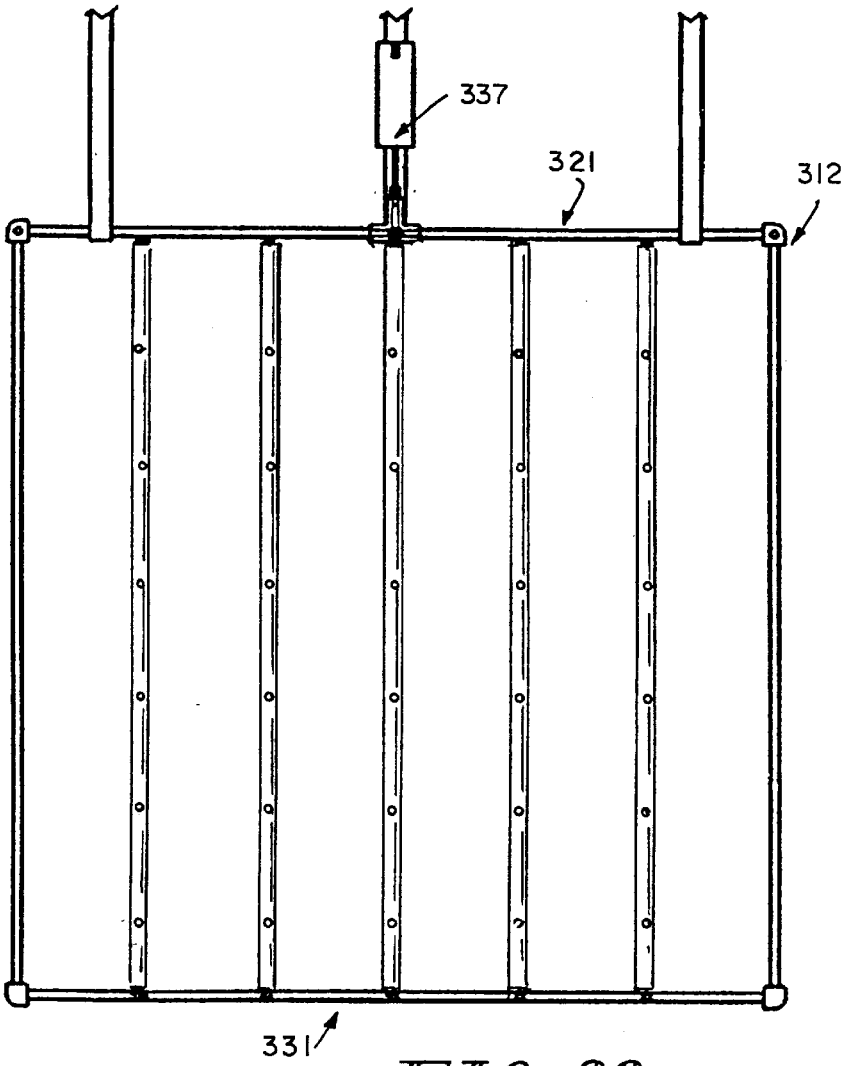
FIG. 20*a–d* illustrate other embodiments constructed according to the present invention, with FIG. 20*a* illustrating a fragmentary side elevational view, FIG. 20*b* illustrating a fragmentary end elevational view, and FIGS. 20*c–d* illustrating enlarged fragmentary end elevational views of two alternative details of the embodiment of FIGS. 20*a–b.*
Figure 20B:
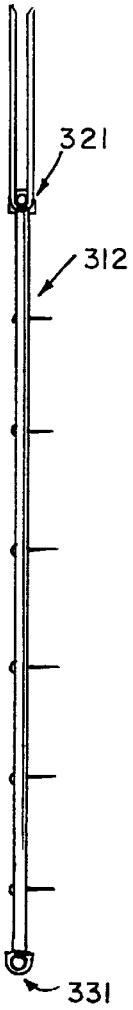
Figure 20C:
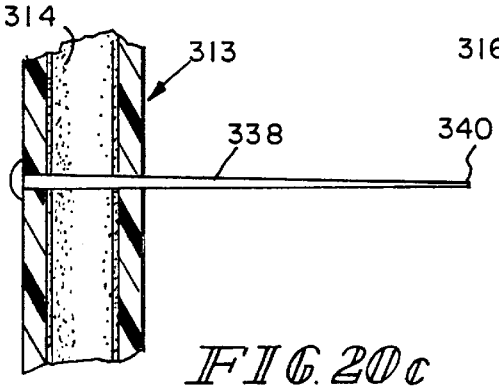
Figure 20D:
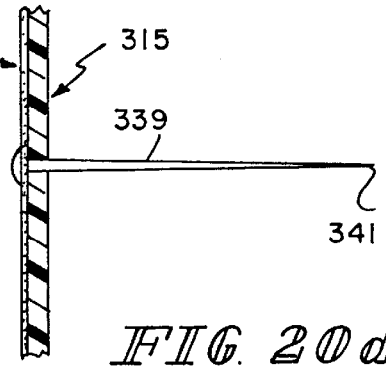

FIG. 19 plots the capacitance of wire electrode and grounded cylinder as a function of $R_o$ for values of $r_o$ of 0.04 and 0.08 mm. In these plots, the common length of the wire and the cylinder was assumed to be 4 cm.

Other embodiments constructed according to the invention are illustrated in FIGS. 20*a–d*. Generally square side frame members 312 are *180* cm on a side. Tubes 313 with semiconductively coated inner walls 314 (FIG. 20*c*) or strips 315 of resinous material coated with a semiconductive coating 316 (FIG. 20*d*), spaced about 30 cm apart are positioned between upper resin frame member 321 and lower resin frame member 331. Suitable electrical connections are made between the semiconductive coating 314 or 316 and a power supply 337, illustratively through the techniques previously discussed. Electrically conductive, for example, stainless steel, needles 338 (FIG. 20*c*) or 339 (FIG. 20*d*) are pushed through the walls of tubes 313 (FIG. 20*c*) or through strips 315 (FIG. 20*d*) at intervals along the lengths of tubes 313 or strips 315. Electrical contact is made to the needles 338 or 339 by virtue of the coating 314 or 316. Electrons provided through semiconductive coating 314 or 316 and emitted from the points 340 or 341 of needles 338 or 339 when power supply 337 is energized create the ionic wind that charges and carries the atomized particles of coating material toward the articles to be coated thereby. Of course, a mesh screen such as the mesh screen 180 of FIG. 17 can also be used with the embodiments of FIGS. 20*a–d* if it is necessary or desirable.

The above data clearly establish that the finer wire (0.08 mm versus 0.5 mm, for example) achieves two desirable ends. First, there is greater ionization, a more highly charged stream or ion wind, and therefore greater coating material transfer efficiency when the finer wire is used. Second, and equally as important from the standpoint of approaching or achieving the 0.25 millijoule discharge energy figure of merit, the capacitance of the charging system is considerably reduced with the finer wire. These conclusions are clearly supported by the above theoretical analyses of the charging and discharging phenomena.

What is claimed is:

1. A coating material dispensing and charging system comprising first electrical conductors extending between first electrically non-conductive supporting members, a power supply, means for coupling the power supply across the first conductors and articles to be coated to maintain a high magnitude electrostatic potential difference across a space defined between the first conductors and the articles, a dispenser for dispensing the coating material into the space, a supply of coating material, and means for supplying the coating material from the coating material supply to the dispenser, the first electrical conductors comprising electrically conductive filaments, the electrically conductive filaments surrounded by electrically non-conductive sheaths.

2. The system of claim 1 wherein the first electrically non-conductive supporting members comprise a first frame constructed from an electrically non-conductive resinous material.

3. The system of claim 2 further comprising a second frame constructed from an electrically non-conductive resinous material across which extend second electrical conductors comprising electrically conductive filaments, the electrically conductive filaments surrounded by electrically non-conductive sheaths, means for coupling the power supply across the second conductors and the articles to be coated to maintain a high magnitude electrostatic potential difference across a space defined between the second conductors and the articles, means for supporting the first frame on one side of a line, means for supporting the second frame on the other side of the line, and means for moving one or more articles to be coated along the line between the first and second frames.

4. The system of claim 3 further comprising at least one third electrically non-conductive resinous material member extending between the first frame and the second frame for maintaining the first and second frames in spaced orientation to permit passage of articles to be coated along the line between the first and second frames.

5. The system of claim 4 further comprising third electrical conductors extending between the first frame and the second frame, the third electrical conductors comprising electrically conductive filaments, the electrically conductive filaments surrounded by electrically non-conductive sheaths.

6. The system of claim 1 further comprising means for supporting the first electrically non-conductive supporting members on one side of a line, and means for moving one or more articles to be coated along the line past the first electrically non-conductive supporting members, the dispenser having an axis along which coating material is dispensed toward the line, the axis making an angle less than about 45° with the line.

7. The system of claim 2 further comprising means for supporting the first frame on one side of a line, and means for moving one or more articles to be coated along the line past the first frame, the dispenser having an axis along which coating material is dispensed toward the line, the axis making an angle less than about 45° with the line.

8. The system of claim 1, 2 or 3 wherein the electrical conductors extend generally vertically.

9. The system of claim 1, 2 or 3 wherein the electrical conductors extend generally horizontally.

10. The system of claim 1, 2 or 3 wherein the electrical conductors have a largest cross-sectional dimension no greater than about 0.01 inch (0.254 mm) transverse to their length.

11. A coating material dispensing and charging system comprising first electrical conductors extending between first electrically non-conductive supporting members, a power supply, means for coupling the power supply across the first conductors and articles to be coated to maintain a high magnitude electrostatic potential difference across a space defined between the first conductors and the articles, a dispenser for dispensing the coating material into the space, a supply of coating material, and means for supplying the coating material from the coating material supply to the dispenser, the first electrical conductors comprising electrically non-insulative materials applied to electrically non-conductive substrates.

12. The system of claim 11 wherein the electrically non-insulative material comprises metal wire and the electrically non-conductive substrates comprise electrically non-conductive filaments, the metal wire wound around the electrically non-conductive filament.

13. The system of claim 11 wherein the electrically non-conductive substrates comprise tubes of electrically non-conductive material, and the electrically non-insulative materials comprise electrically non-insulative coating applied to the insides of the tubes and fine wire-like electrodes extending through the walls of the tubes in electrical contact with the electrically non-insulative coating and exposed to the space.

14. The system of claim 11 wherein the electrically non-conductive substrates comprise strips of electrically non-conductive material, and the electrically non-insulative materials comprise electrically non-insulative coating applied to the strips and fine wire-like electrodes mounted on the strips in electrical contact with the electrically non-insulative coating and exposed to the space.

15. A method of dispensing coating material comprising providing first electrically conductive filaments surrounded by electrically non-conductive sheaths and extending between first electrically non-conductive supporting members, providing a dispenser for dispensing the coating material, providing a supply of coating material to the dispenser, coupling the power supply across the first electrically conductive filaments and the articles to be coated to maintain a high magnitude electrostatic potential difference across a space defined between the first electrically conductive filaments and the articles, and dispensing the coating material into the space.

16. The method of claim 15 wherein the step of providing first electrically non-conductive supporting members comprises the step of providing a first frame constructed from an electrically non-conductive resinous material.

17. The method of claim 16 further comprising the steps of providing a second frame constructed from an electrically non-conductive resinous material across which extend second electrically conductive filaments surrounded by electrically non-conductive sheaths, coupling the power supply across the second electrically conductive filaments and the articles to be coated to maintain a high magnitude electrostatic potential difference across a space defined between the second electrically conductive filaments and the articles, supporting the first frame on one side of a line, supporting the second frame on the other side of the line, and moving one or more articles to be coated along the line between the first and second frames.

18. The method of claim 17 further comprising the step of providing at least one third electrically non-conductive resinous material member extending between the first frame and the second frame for maintaining the first and second frames in spaced orientation to permit passage of articles to be coated along the line between the first and second frames.

19. The method of claim 18 further comprising the steps of providing third electrically conductive filaments surrounded by electrically non-conductive sheaths and extending between the first frame and the second frame, and coupling the power supply across the third electrically conductive filaments and the articles to be coated to maintain a high magnitude electrostatic potential difference across a space defined between the third electrically conductive filaments and the articles.

20. The method of claim 15, 17 or 19 wherein the step of providing electrically conductive filaments surrounded by electrically non-conductive sheaths comprises the step of providing fine metal wires and sheaths selected from the group consisting of synthetic materials and glass.

21. A method of dispensing coating material comprising providing first electrically non-insulative materials applied to electrically non-conductive substrates extending between first electrically non-conductive supporting members, providing a dispenser for dispensing the coating material, providing a supply of coating material to the dispenser, coupling the power supply across the first conductors and the articles to be coated to maintain a high magnitude electrostatic potential difference across a space defined between the first conductors and the articles, and dispensing the coating material into the space.

22. The system of claim 21 wherein the electrically non-conductive substrates comprise tubes of electrically non-conductive material, and the electrically non-insulative materials comprise electrically non-insulative coating applied to the insides of the tubes and fine wire-like electrodes extending through the walls of the tubes in electrical contact with the electrically non-insulative coating and exposed to the space.

23. The system of claim 21 wherein the electrically non-conductive substrates comprise strips of electrically non-conductive material, and the electrically non-insulative materials comprise electrically non-insulative coating applied to the strips and fine wire-like electrodes mounted on the strips in electrical contact with the electrically non-insulative coating and exposed to the space.

24. The method of claim 21 wherein the step of providing first electrically non-conductive supporting members comprises the step of providing a first frame constructed from an electrically non-conductive resinous material.

25. The method of claim 24 comprising the steps of providing a second frame constructed from an electrically non-conductive resinous material across which extend second electrically non-insulative materials applied to electrically non-conductive substrates, coupling the power supply across the second electrically non-insulative materials and the articles to be coated to maintain a high magnitude electrostatic potential difference across a space defined between the second electrically non-insulative materials and the articles, supporting the first frame on one side of a line, supporting the second frame on the other side of the line, and moving one or more articles to be coated along the line between the first and second frames.

26. The method of claim 25 further comprising the step of providing at least one third electrically non-conductive resinous material member extending between the first frame and the second frame for maintaining the first and second frames in spaced orientation to permit passage of articles to be coated along the line between the first and second frames.

27. The method of claim 26 further comprising the steps of providing third electrically non-insulative materials applied to electrically non-conductive substrates extending between the first frame and the second frame, and coupling the supply across the third electrically non-insulative materials and the articles to be coated to maintain a high magnitude electrostatic potential difference across a space defined between the third electrically non-insulative materials and the articles.

28. The method of claim 21, 25 or 27 wherein the step of providing electrically non-conductive substrates comprises the step of providing electrically non-conductive filaments, and the step of providing electrically non-insulative material comprises the step of providing metal wire wound around the electrically non-conductive filament.

29. A coating material dispensing and charging system comprising first fine metal wires surrounded by electrically non-conductive sheaths comprising material selected from the group consisting of synthetic materials and glass, the first fine metal wires extending between first electrically non-conductive supporting members, a power supply, means for coupling the power supply across the first fine metal wires and articles to be coated to maintain a high magnitude electrostatic potential difference across a space defined between the first fine metal wires and the articles, a dispenser for dispensing the coating material into the space, a supply of coating material, and means for supplying the coating material from the coating material supply to the dispenser.

30. The system of claim 29 wherein the sheath comprises nylon.

31. The system of claim 29 wherein the sheath comprises glass.

32. The system of claim 29, 30 or 31 further comprising second electrically non-conductive supporting members, second fine metal wires surrounded by electrically non-conductive sheaths comprising material selected from the group consisting of synthetic materials and glass, the second fine metal wires extending between the second electrically non-conductive supporting members, and means for coupling the power supply across the second fine metal wires and the articles to be coated to maintain a high magnitude electrostatic potential difference across a space defined between the second fine metal wires and the articles.

33. A coating material dispensing and charging system comprising first metal wires wound around electrically non-conductive filaments and extending between first electrically non-conductive supporting members, a power supply, means for coupling the power supply across the first metal wires and articles to be coated to maintain a high magnitude electrostatic potential difference across a space defined between the first metal wires and the articles, a dispenser for dispensing the coating material into the space, a supply of coating material, and means for supplying the coating material from the coating material supply to the dispenser.

34. The system of claim 33 further comprising a coating on the metal wire wound around the electrically nonconductive filament to reduce the likelihood of displacement of the metal wire along the length of, or unwinding of the metal wire from, the electrically non-conductive filament.

35. The system of claim 33 or 34 further comprising second electrically non-conductive supporting members, second metal wires wound around electrically non-conductive filaments and extending between the second electrically non-conductive members, and means for coupling the power supply across the second metal wires and the articles to be coated to maintain a high magnitude electrostatic potential difference across a space defined between the second metal wires and the articles.

36. A coating material dispensing and charging system comprising first electrical conductors extending between first electrically non-conductive supporting members, the first electrical conductors comprising electrically non-insulative material applied to electrically non-conductive substrates, a power supply, means for coupling the power supply across the first conductors and articles to be coated to maintain a high magnitude electrostatic potential difference across a space defined between the first conductors and the articles, a dispenser for dispensing the coating material into the space, a supply of coating material, and means for supplying the coating material from the coating material supply to the dispenser, the electrically non-conductive substrates comprising electrically non-conductive filaments, and the electrically non-insulative material comprising a carbon-containing coating applied to the electrically non-conductive filaments.

37. A coating material dispensing and charging system comprising first electrical conductors extending between first electrically non-conductive supporting members, the first electrical conductors comprising electrically non-insulative material applied to electrically non-conductive substrates, a power supply, means for coupling the power supply across the first conductors and articles to be coated to maintain a high magnitude electrostatic potential difference across a space defined between the first conductors and the articles, a dispenser for dispensing the coating material into the space, a supply of coating material, and means for supplying the coating material from the coating material supply to the dispenser, the electrically non-conductive substrates comprising tubes of electrically non-conductive material, and the electrically non-insulative materials comprising electrically non-insulative coating applied to the insides of the tubes and fine wire-like electrodes extending through the walls of the tubes in electrical contact with the electrically non-insulative coating and exposed to the space.

38. A coating material dispensing and charging system comprising first electrical conductors extending between first electrically non-conductive supporting members, the first electrical conductors comprising electrically non-insulative material applied to electrically non-conductive substrates, a power supply, means for coupling the power supply across the first conductors and articles to be coated to maintain a high magnitude electrostatic potential difference across a space defined between the first conductors and the articles, a dispenser for dispensing the coating material into the space, a supply of coating material, and means for supplying the coating material from the coating material supply to the dispenser, the electrically non-conductive substrates comprising strips of electrically non-conductive material, and the electrically non-insulative materials comprising electrically non-insulative coating applied to the strips and fine wire-like electrodes mounted on the strips in electrical contact with the electrically non-insulative coating and exposed to the space.

39. A coating material dispensing and charging system comprising first electrical conductors extending between first electrically non-conductive supporting members, the first electrical conductors comprising electrically conductive filaments surrounded by electrically semiconductive sheaths, a power supply, means for coupling the power supply across the first conductors and articles to be coated to maintain a high magnitude electrostatic potential difference across a space defined between the first conductors and the articles, a dispenser for dispensing the coating material into the space, a supply of coating material, and means for supplying the coating material from the coating material supply to the dispenser.

40. The system of claim 39 wherein the electrically conductive filaments comprise fine metal wires and the sheaths comprise carbon-containing coating applied to the electrically conductive filaments.

41. The system of claim 39 or 40 further comprising second electrically non-conductive supporting members, second electrical conductors extending between the second electrically non-conductive members, the second electrical conductors comprising electrically conductive filaments surrounded by electrically semiconductive sheaths, and means for coupling the power supply across the second electrical conductors and the articles to be coated to maintain a high magnitude electrostatic potential difference across the space between the second conductors and the articles.

42. The system of claim 41 further comprising at least one third electrically non-conductive member extending between one of the first electrically non-conductive supporting members and one of the second electrically non-conductive supporting members for maintaining the first and second electrically non-conductive supporting members in spaced orientation to permit passage of articles to be coated between the first and second electrical conductors.

43. A coating material dispensing and charging system comprising a first electrical conductor extending between a first electrically non-conductive supporting member and a second electrically non-conductive supporting member, means for moving one of the first and second electrically non-conductive supporting members relative to the other of the first and second electrically non-conductive supporting members to move the first electrical conductor generally in a plane adjacent articles to be coated by the coating material, a power supply, means for coupling the power supply across the first conductor and articles to be coated to maintain a high magnitude electrostatic potential difference across a space defined between the first conductor and the articles, a dispenser for dispensing the coating material into the space, a supply of coating material, and means for supplying the coating material from the coating material supply to the dispenser.

44. The system of claim 43 further comprising third and fourth electrically non-conductive supporting members, a second electrical conductor extending between the third and fourth electrically non-conductive supporting members, means for moving one of the third and fourth electrically non-conductive supporting members relative to the other of the third and fourth electrically non-conductive supporting members to move the second electrical conductor generally in a plane adjacent articles to be coated by the coating material, and means for coupling the power supply across the second electrical conductor and the articles to be coated to maintain a high magnitude electrostatic potential difference across a space defined between the second conductor and the articles.

45. The system of claim 44 further comprising means for conveying articles to be coated along a line between the first and second conductors.

46. The system of claim 43, 44 or 45 wherein the first and second electrical conductors comprise electrically non-insulative materials applied to electrically non-conductive substrates.

47. The system of claim 46 wherein the electrically non-conductive substrates comprise tubes of electrically non-conductive material, and the electrically non-insulative materials comprise electrically non-insulative coating applied to the insides of the tubes and fine wire-like electrodes extending through the walls of the tubes in electrical contact with the electrically non-insulative coating and exposed to the space.

48. The system of claim 46 wherein the electrically non-conductive substrates comprise strips of electrically non-conductive material, and the electrically non-insulative materials comprise electrically non-insulative coating applied to the strips and fine wire-like electrodes mounted on the strips in electrical contact with the electrically non-insulative coating and exposed to the space.

* * * * *